US011253973B2

(12) United States Patent
Ojalehto

(10) Patent No.: US 11,253,973 B2
(45) Date of Patent: Feb. 22, 2022

(54) FLUID PRESSURE VISE ACTUATOR

(71) Applicant: Rapid Design Solutions, LLC, Monroe, WA (US)

(72) Inventor: Troy William Ojalehto, Monroe, WA (US)

(73) Assignee: Rapid Design Solutions, LLC, Monroe, WA (US)

( * ) Notice: Subject to any disclaimer, the term of this patent is extended or adjusted under 35 U.S.C. 154(b) by 411 days.

(21) Appl. No.: 16/394,779

(22) Filed: Apr. 25, 2019

(65) Prior Publication Data

US 2019/0366512 A1 Dec. 5, 2019

Related U.S. Application Data

(60) Provisional application No. 62/678,811, filed on May 31, 2018.

(51) Int. Cl.

| | |
|---|---|
| ***B25B 1/18*** | (2006.01) |
| ***B25B 1/02*** | (2006.01) |
| *F15B 15/06* | (2006.01) |
| *B25B 1/06* | (2006.01) |

(52) U.S. Cl.

CPC ..... *B25B 1/18* (2013.01); *B25B 1/02* (2013.01); *B25B 1/06* (2013.01); *F15B 15/065* (2013.01)

(58) Field of Classification Search

CPC .... B25B 7/22; B25B 1/18; B25B 1/06; B25B 1/02; B25B 1/103; B25B 1/20; B25B 1/24; B25B 5/06; B25B 5/061; B25B 1/2431; B25B 1/2442; B25B 1/2489; B25B 27/10; B25B 7/02; F15B 15/065; F16H 19/04; F01B 9/047; Y10T 74/19623; Y10T 74/1967; B25J 15/026

USPC ..... 92/136; 74/409, 422

See application file for complete search history.

(56) References Cited

U.S. PATENT DOCUMENTS

| | | | | |
|---|---|---|---|---|
| 2,328,061 A * | 8/1943 | Curtis | B25B 1/18 | 269/32 |
| 4,483,218 A * | 11/1984 | Beck | B23D 63/003 | 76/78.1 |
| 6,385,831 B1 * | 5/2002 | Grund | B23Q 5/266 | 29/38 C |
| 2013/0181469 A1 * | 7/2013 | Williams | B25B 1/06 | 294/207 |

FOREIGN PATENT DOCUMENTS

GB 646677 A 1 * 11/1950

* cited by examiner

*Primary Examiner* — Mahdi H Nejad
(74) *Attorney, Agent, or Firm* — FIG. 1 Patents

(57) ABSTRACT

A fluid pressure vise actuator includes a housing and an inner bore of the housing. A piston is disposed in the housing, and the piston is configured to actuate based on a pressure increase in ports of the housing. A gear is also disposed in the inner bore of the housing, and a portion of the gear is adjacent to the piston such that an actuation of the piston is configured to rotate the gear. The gear includes a socket configured to interface with a vise and operate the vise based on a rotation of the gear. The housing also includes adjustable clamping blocks configured to engage with the vise to provide support for the housing during operation. An adjustment of the clamping blocks enables the fluid pressure vise actuator to interface with multiple types of existing vises.

20 Claims, 12 Drawing Sheets

FLUID PRESSURE VISE ACTUATOR

CROSS-REFERENCE TO RELATED APPLICATIONS

This Application claims the benefit of U.S. Provisional Application No. 62/678,811, filed on May 31, 2018, the entire disclosure of which is hereby incorporated by reference herein.

BACKGROUND

In the context of manufacturing, e.g., manufacturing using a milling machine, a vise fixture is a type of work holding system that can be configured to secure a workpiece against forces applied to the workpiece during the manufacturing process. Typically, vise fixtures include a vise and a system for operating or actuating the vise. In general terms, a vise is a holding system having at least two jaws that are adjustable to increase and/or decrease a magnitude of a force applied to a workpiece disposed between the at least two jaws. The most common type of vise used in manufacturing is operated by rotating a lead screw which mechanically opens or closes jaws of the vise. For example, machining techniques such as drilling and milling are often used when machining features of a workpiece that is securely held between jaws of a vise during the manufacturing process. After the manufacturing process is complete, the jaws of the vise can be adjusted to release the workpiece.

Some conventional techniques to operate a vise utilize a tool such as a wrench attached to a lead screw which is rotated manually by a machine operator or a machinist. However, the repetitive task of manually opening and closing a vise is time-consuming and inefficient. Also, manual vise operation usually relies on the machine operator's individual experience and "feel" with regard to an amount of torque applied to the lead screw which directly correlates to an amount of force applied to the workpiece by the jaws of the vise. It is critical for the jaws of the vise to apply a specific amount of force to the workpiece because if the magnitude of this force is too high, then the workpiece may be damaged and if the magnitude is too low, then the workpiece may be dislodged from the vise jaws during the machining processes.

Moreover, vises are commonly used as work holding systems in computer numerical control (CNC) milling operations. CNC manufacturing is ubiquitous in the manufacturing industry and it automates nearly every step of the manufacturing process. In conventional CNC manufacturing, a CNC operator or machinist will set up and program the machine to manufacture a specific part, and the rest of the process is automated as the CNC runs the program and manufactures the specific part.

Although CNC manufacturing automates most of the manufacturing process, human involvement is still necessary and this is generally undesirable for many reasons. For example, humans can make mistakes, can be unreliable, and usually account for a significant portion of the cost to manufacture components. As a result, most CNC manufacturing operations have implemented systems that further reduce the amount of human involvement required in manufacturing. Thus, it is common for CNC manufacturers to use robotics to automate the operation of production runs and it is also possible to program machines remotely if programming is required at all. For example, the programming of machines to manufacture a particular part may only need to be performed a single time to manufacture the particular part multiple times.

In many CNC manufacturing shops, the move towards complete automation has been a gradual process. Often, aspects of the manufacturing operations are automated one aspect at a time, and vise operation is one of the most common aspects of CNC manufacturing that is not automated because of the challenges involved in such automation. For example, the manufacturing industry's piecemeal approach to automation often means that a particular machine shop has gradually developed multiple independent automated processes which may include automation components from multiple different manufacturers and/or customized components. Since vise operation is central to the CNC milling process, automating this operation is particularly challenging in terms of compatibility with the various other aspects of existing manufacturing operations in many manufacturing centers.

This compatibility challenge is particularly common for machine shops that engage in the manufacturing of short to medium duration production runs to make less common components since these machine shops have diverse automation needs. For example, this type of manufacturing usually does not require more than six months of continuous machine run time per job. This means that manufacturing operations of this type may use a first robotic system to automate an aspect of manufacturing aeronautical parts for six months and a second robotic system to automate an aspect of manufacturing medical device parts for the following six months, and so on.

Conventional systems used to automate vise operation utilize hydraulic and pneumatic fluid pressure systems. However, these conventional fluid pressure vise operating systems are limited in their ability to fix to different shapes and sizes of existing vise fixtures and in their ability to interface with existing robotic systems. Thus, conventional vise operating systems are not compatible with existing manufacturing operations.

Instead, these systems require obtaining a custom vise and robotic system designed specifically for the respective system, which results in high startup and replacement costs. These costs also typically include a large capital expenditure for the installation of operating systems such as auxiliary pumps and control valves. As such, conventional systems fail to provide the majority of machine shops with cost-effective solutions for automating vise operations.

Additionally, conventional systems used to automate vise operation that utilize hydraulic and pneumatic fluid pressure systems directly apply a clamping force to jaws of a vise. However, in the event of pressure failure (e.g., loss of pressure supply or loss of control of the pressure supply), these conventional fluid pressure vise operating systems risk costly damages to workpieces held in the vise. For example, in systems which utilize pressurized fluid to apply a clamping force, the clamping force applied to a workpiece may be lost during machining and result in damages to the workpiece as it is no longer secured. In systems which control the pressure supply to unclamp and regulate the clamping force on a workpiece (e.g., spring clamping systems), the vise may be unable to unclamp and result in damages to the workpiece due to an excessive clamping force.

SUMMARY

Systems and techniques are described for a fluid pressure vise actuator. The fluid pressure vise actuator includes a housing and an inner bore of the housing. A piston is disposed in the housing that is configured to actuate based on a pressure increase in ports of the housing. A piston guide is disposed in the inner bore of the housing and the piston guide includes a channel. A portion of the piston is disposed in the channel which guides an actuation of the piston. A gear is also disposed in the inner bore of the housing, and a portion of the gear is adjacent to the piston such that the actuation of the piston is configured to rotate the gear.

The gear includes a socket, e.g., a hex socket, configured to interface with a vise and operate the vise based on the rotation of the gear. Additionally, the housing can include clamping blocks configured to engage with the vise to provide support for the housing during operation. The clamping blocks are also adjustable which allows the fluid pressure vise actuator to interface with multiple types of existing vises.

The ports of the housing can include a first pressure port and a second pressure port. A pressurized fluid such as air may be used to increase a pressure in the first pressure port. This increase in the pressure applies a force to a first portion of the piston and the applied force can cause the piston to actuate in a first direction. As the piston actuates in the first direction a force of friction between the piston and the gear causes the gear to rotate in a first rotational direction. This rotation can rotate a lead screw of a vise, e.g., in the first rotational direction to open or close jaws of the vise. Similarly, the pressurized fluid can be used to increase a pressure in the second pressure port which applies a force to a second portion of the piston such that the piston actuates in a second direction. As the piston actuates in the second direction, the force of friction between the piston and the gear causes the gear to rotate in a second rotational direction. Rotating the gear in the second rotational direction can rotate the lead screw of the vise in the second rotational direction. By rotating the lead screw in either the first rotational direction or the second rotational direction, the described systems can efficiently open and/or close the jaws of the vise.

The described systems and techniques provide several advantages over conventional manual vise operation by eliminating the unpredictability and the costs associated with human vise operation. Further, these systems overcome shortcomings of conventional automation that directly apply a clamping force to jaws of a vise which can be unexpectedly lost in the event of a loss of power. Additionally, the systems and techniques described can operate many different types and sizes of vises and/or vise fixtures which is not possible using conventional systems.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTIONS OF THE DRAWINGS

The detailed description is described with reference to the accompanying figures. Entities represented in the figures may be indicative of one or more entities and thus reference may be made interchangeably to single or plural forms of the entities in the discussion.

DETAILED DESCRIPTION

Overview

Figure 1:
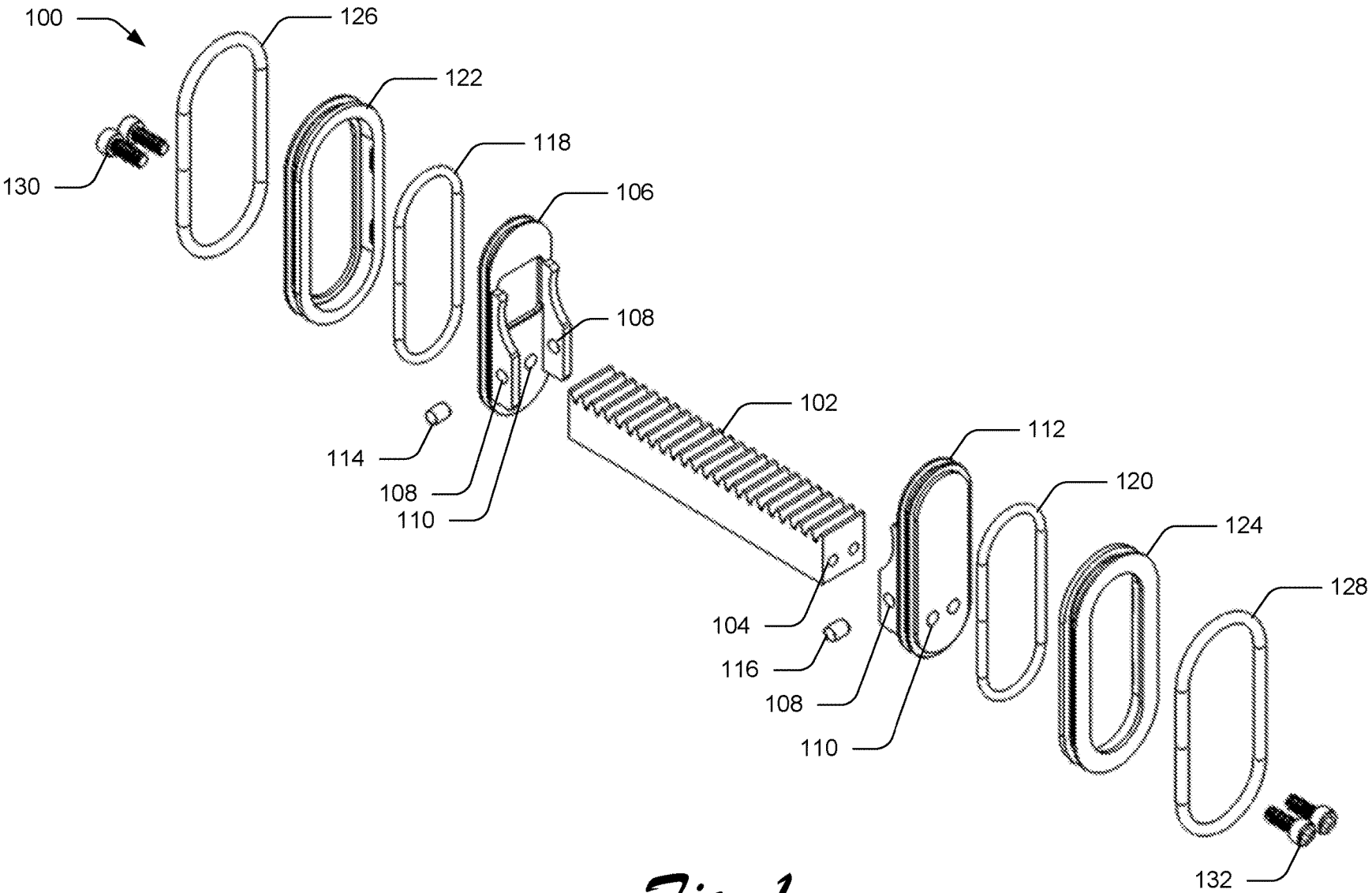
FIG. 1 is a schematic diagram illustrating an exploded view of a piston assembly.

A vise fixture is a work holding system that can be configured to secure a workpiece against forces applied to the workpiece during machining operations such as drilling and milling. Typically, vise fixtures include a vise and a system for operating or actuating the vise. In general terms, a vise is a holding system having at least two jaws that are adjustable to increase and/or decrease a magnitude of a force applied to a workpiece disposed between the at least two jaws. The most common type of vise used in manufacturing is operated by rotating a lead screw which mechanically closes jaws of the vise to secure a workpiece or opens the jaws of the vise to release the workpiece.

Vises are commonly used as work holding systems in computer numerical control (CNC) milling operations. Although CNC manufacturing automates most of the manufacturing process, human involvement is still necessary and this is generally undesirable. This is because humans can make mistakes, can be unreliable, and usually account for a significant portion of the cost to manufacture components. As a result, most CNC manufacturing operations have implemented systems that further reduce the amount of human involvement required in manufacturing such as by using programmable robotics to automate the operation of production runs. Often, aspects of the manufacturing operations are automated one aspect at a time, and vise operation is one of the most common aspects of CNC manufacturing that is not automated.

Conventional systems used to automate vise operation utilize hydraulic and pneumatic fluid pressure systems. However, these conventional systems are limited in their ability to fix to different shapes and sizes of existing vise fixtures and in their ability to interface with existing robotic systems. As such, these conventional vise operating systems are not compatible with many existing manufacturing operations. Instead, these systems require obtaining a custom vise and robotic system designed specifically for the respective system, which results in high startup and replacement costs. Further, conventional approaches to automating vise operations for machine shops are configured for long duration and even permanent production runs. These conventional approaches, however, are not practical (e.g., due to expenses and/or flexibility of shop arrangement) for short to medium duration production runs to make less common components. This is because these types of machining operations are often partially automated using various technologies and custom designs that were not intended to be compatible with conventional hydraulic and pneumatic systems.

Additionally, conventional systems used to automate vise operation that utilize hydraulic and pneumatic systems directly apply a clamping force to jaws of a vise. In the event of a pressure failure (e.g., loss of air or hydraulic pressure supply), these conventional vise operating systems risk damages to workpieces held in the vise. Also, these conventional systems require a large amount of pneumatic piston surface area to generate an adequate amount of clamping force. This is commonly accomplished by utilizing a large piston or multiple smaller pistons stacked axially. However, the large amount of manufacturing area required to implement these conventional systems consumes a large amount of space in a machining environment, which is generally quite limited. Other conventional systems overcome this problem by utilizing high-pressure fluid systems such as hydraulic systems to apply a clamping force. However, this typically involves purchasing and installing systems such as auxiliary pumps and control valves at a high expense and failure of just one of these additional systems can prevent functionality of all manufacturing operations until the failure is resolved.

Fluid pressure vise actuator systems and techniques are described herein. The fluid pressure vise actuator includes a housing, a piston, and a gear. The housing has a housing first end, a housing second end, an inner bore, a first pressure port, and a second pressure port. The inner bore extends between the housing first end and the housing second end. The piston has a piston first end and a piston second end, and the piston is disposed in the inner bore of the housing. The gear is also disposed in the inner bore of the housing such that a portion of the gear is adjacent to a portion of the piston.

Pressurized fluid such as air is used to increase pressure in the first pressure port or the second pressure port of the housing. Generally speaking, the first pressure port is disposed between the housing first end and the piston first end. Similarly, the second pressure port is disposed between the housing second end and the piston second end. Notably, both the first pressure port and second pressure port are sealed within the housing. In one example, the first pressure port and the second pressure port can be hermetically sealed within the housing.

An increase in a pressure in the first pressure port or the second pressure port is configured to actuate the piston in the housing. For example, increasing a pressure in the first pressure port while depressurizing the second pressure port (e.g., opening to atmospheric pressure) applies a force to the piston first end which causes the piston to actuate in a direction of the applied force. An actuation of the piston causes the gear to rotate in a rotational direction corresponding to a direction of actuation of the piston. For example, the piston can include a rack that creates a force of friction between the rack and the adjacent portion of the gear which enables the gear to rotate based on the actuation of the piston.

The gear has a hollow center and the gear includes a socket located through this hollow center. The socket is configured to interface with a rotational mechanism such as a lead screw of a vise. For instance, the socket can have a geometry configured to interface with a geometry of a portion of the lead screw such that independent rotational motion between the lead screw and the socket is temporarily prevented while the lead screw is disposed within the socket. In this way, a rotation of the gear and a corresponding rotation of the socket is configured to rotate the rotation mechanism of the vise such as the lead screw. Thus, by increasing a pressure in the first pressure port or the second pressure port, the piston may actuate in a direction causing the gear to rotate in a rotational direction and therefore rotate a rotational mechanism such as a lead screw to operate a vise (e.g., opening and closing jaws of the vise). In this way, the fluid pressure vise actuator is configured to operate a vise efficiently to augment automation of existing CNC milling systems.

As described herein, the piston is configured to actuate in a first direction based on an increase in pressure in the first pressure port. In an example in which the second pressure port is concurrently pressurized, a depressurization of the second pressure port may facilitate an actuation of the piston in the first direction. Similarly, the piston is configured to actuate in a second direction based on an increase in pressure in the second port. In another example in which the first pressure port is concurrently pressurized, a depressurization of the first port may facilitate an actuation of the piston in the second direction. It is to be appreciated that the first and second directions may be opposing directions. Accordingly, the piston is configured to rotate the gear in a first rotational direction based on an actuation of the piston in the first direction and the piston is configured to rotate the gear in a second rotational direction based on an actuation of the piston in the second direction.

In one or more embodiments, the fluid pressure vise actuator is configured to operate a vise by closing jaws of the vise. For example, an influx of pressurized fluid such as air increases a pressure in a pressure port which applies a force to the piston. The applied force actuates the piston within the housing. A force of friction between the piston and the gear rotates the gear as the piston is actuated. The rotation of the gear rotates the socket of the gear which rotates a lead screw of the vise as a portion of the lead screw may be disposed within the socket. The rotation of the lead screw closes the vise jaws which apply a force to a workpiece disposed between the vise jaws.

In some examples in which the gear interfaces with a lead screw of a vise, the rotation of the gear in the first rotational direction may cause jaws of the vise to open while a rotation of the gear in the second rotational direction may cause the jaws of the vise to close. In other examples, the rotation of the gear in the first rotational direction may cause the jaws of the vise to close while a rotation of the gear in the second rotational direction may cause the jaws of the vise to open. Thus, in a two jaw vise having a stationary jaw and an adjustable jaw, a rotation of the gear in the first rotational direction may actuate the adjustable jaw towards the stationary jaw and a rotation of the gear in the second rotational direction may actuate the adjustable jaw away from the stationary jaw. In an example of operation of a vise with multiple adjustable jaws, one or more valves may be used such that a pressurized air is controllable to selectively actuate the multiple adjustable jaws towards each other as well as to selectively actuate the multiple adjustable jaws away from each other.

Furthermore, by closing jaws of a vise, the fluid pressure vise actuator operates the vise to apply a clamping force to a workpiece held between the jaws. For example, as the jaws of the vise close, an initial contact is made between the jaws and the workpiece disposed between the jaws. A clamping force is created between the jaws and the workpiece and the magnitude of this clamping force increases as the jaws continue to close after the initial contact is made. A magnitude of a torque applied to rotate the lead screw is proportional to the amount of displacement of the jaws and thus the magnitude of the applied torque is proportional to a magnitude of the clamping force applied to the workpiece. As such, the magnitude of the clamping force applied to the workpiece can be adjusted by adjusting a torque used to rotate the lead screw. Accordingly, the fluid pressure vise actuator is configured to adjust a magnitude of a clamping force applied to a workpiece by adjusting the amount of pressure supplied to the housing.

Consider an example in which a first pressure is supplied to the first pressure port of the housing in order to apply a clamping force on a workpiece. In this example, the first pressure in the first pressure port applies a constant first force to the piston first end which causes the piston to actuate in the first direction. A force of friction between the gear and the piston applies a first moment force to the gear which causes the gear to rotate in a first rotational direction. The rotation of the gear then applies a first torque to the lead screw disposed in the socket of the gear. The first torque is proportional to the first moment force applied to the gear and causes the lead screw to rotate. The rotation of the lead screw causes the jaws to close and apply a first clamping force on the workpiece. Notably, the pressure supplied to the housing is proportional to a magnitude of the clamping force applied to the workpiece.

Now consider this example in which a second pressure is supplied to the first pressure port to increase a magnitude of a clamping force applied to the workpiece. In this example, the second pressure is greater than the first pressure. As such, a second pressure applies a constant second force to the piston to actuate the piston. The actuation of the piston applies a second moment force to the gear which in turn applies a second torque to the lead screw of the vise. The second torque causes the lead screw to rotate and apply a second clamping force on the workpiece. However, because the second pressure supplied is greater than the first pressure, a magnitude of the second clamping force is greater than a magnitude of the first clamping force. In this way, the fluid pressure vise actuator is configured to adjust the clamping force applied to a workpiece by adjusting an amount of pressure in the first pressure port or the second pressure port.

Further, by consistently applying a same pressure to the first pressure port or second pressure port during the operation of a vise, a consistent clamping force may be achieved while manufacturing a plurality of parts. Also, by applying a consistent pressure the present system is also configured to consistently open the vise a same amount while manufacturing a plurality of parts. By doing so, the fluid pressure vise actuator provides the advantage of not relying on the machine operator's individual experience and "feel" with regard to an amount of force applied to the workpiece and the amount the vise opens after it has been machined. Also, consistently opening the vise the same amount eliminates the risk of a vise operator not opening the vise enough such that a robotic system may misplace a workpiece as it loads it on the vise. This also mitigates the risk of a vise operator opening the vise too much such that the workpiece falls which can damage both the workpiece and the surrounding manufacturing equipment as well as cause injury to the operator.

In one example, fluid pressure lines such as airlines are configured to supply pressurized fluid to the fluid pressure vise actuator. These fluid pressure lines may be "shop" fluid pressure lines commonly available in machining environments. In some cases, the fluid pressure supply lines are configured to alternately supply pressurized fluid (e.g., fluid pressure) to a pressure port and depressurize a pressure port of the fluid pressure vise actuator. This supply of fluid pressure may be regulated and adjusted in connection with a robotic system and/or CNC milling systems. In this way, the fluid pressure vise actuator may be configured to operate a vise in connection with partially automated robotic and CNC milling systems to further automate the manufacturing process.

Continuing with the example in which the first supplied pressure causes the proportional first clamping force on the workpiece, consider an instance in which a pressure failure results in a loss of the supplied first pressure. The loss of the first pressure subsequently results in a loss of the first force on the piston, the first moment on the gear, and the first torque on the lead screw. However, the loss of the first pressure does not result in a loss of the first clamping force. This is because in general, a lead screw of a vise does not rotate to open or close the jaws of the vise without a sufficient torque being applied to the lead screw. So in this case, the loss of the first torque on the lead screw still maintains the first clamping force because there is not a sufficient opposing torque applied to the lead screw to rotate the lead screw and open the vise. In this way, the fluid pressure vise actuator is configured to maintain a constant clamping force on a workpiece in the case of pressure failure. In contrast, conventional systems that utilize fluid pressure fail to maintain a clamping force in the event of pressure failure because they directly apply a clamping force on the vise without directly rotating the lead screw.

In one or more embodiments, the housing may further include clamping blocks which may be configured to engage with the vise to provide support for the housing such that the housing is secured to the vise. Particularly, the clamping blocks engage with, conform to, interact with, or attach to a vise to provide anti-rotational support during the operation of the vise. This is necessary because torque is applied to the housing due to the applied torque on the lead screw of the vise during operation. For example, in cases where the torque required to rotate the lead screw is greater than the torque required to rotate the housing, the housing will rotate independently without rotating the lead screw. By providing anti-rotational support via the clamping blocks, the housing is incapable of rotating, and thus any torque applied to the lead screw is configured to rotate the lead screw.

Additionally, the clamping blocks may also be adjustable to engage with or connect to various types of vise fixtures which is not possible using conventional vise operation systems. For instance, the clamping blocks may be adjusted along the housing to engage with and attach to vise fixtures having various geometries and sizes, e.g., in order to apply anti-rotational support during vise operation. Further, the housing may comprise one or more magnets to temporarily fix the housing to a vise by a magnetic force between the magnets and a magnetic portion of the vise. In some examples, the magnetic force between the magnets and the portion of the vise has a magnitude large enough to prevent the housing from detaching from the vise in a direction parallel to the lead screw during operation of the vise. In this way, the fluid pressure vise actuator may be quickly secured to a plurality of existing vise fixtures at low-cost and time investment. The described systems can also be quickly unsecured or decoupled from the vise to support efficient switching back-and-forth between manual and automated vise operation.

In some embodiments, the housing may also include one or more sensors. For example, the sensors can be configured to detect the localized presence or absence of portions of the system. In response to such detection, the sensors or a corresponding electrical circuit may output an electrical output, such as a signal indicating the localized presence or absence of the portions of the system. By way of example, a sensor such as a magnetic sensor may be configured to output an electrical signal based on a sensing medium such as a magnet coming into close proximity with the sensor. In another example, the housing may include one or more switches or tactile sensors configured to generate and output an electrical signal in response to the presence or absence of portions of the system.

Consider an example in which the piston first end and the piston second end each include a mechanism or feature detectable by sensors, and the housing includes a sensor configured to detect the mechanism or feature when disposed proximate the housing first end and another sensor configured to detect the mechanism or feature when disposed proximate the housing second end. In this example, pressurized fluid such as air may be supplied to the first pressure port such that the piston actuates in the first direction configured to rotate the gear and a lead screw disposed in the socket in the first rotational direction. A rotation of the lead screw in the first rotational direction causes the jaws of the vise to close and apply a clamping force to a workpiece. While the piston actuates in the first direction, the detectable mechanism or feature in the piston second end comes into proximity with the sensor disposed proximate to the housing second end. This proximity is detectable by the sensor. In response to detection of the mechanism or feature by the sensor, the system can output an electrical signal as an indicator of the detection. In one or more embodiments, the sensors may be connected to an external system such as a robotic system, programmable logic controller (PLC) system, CNC milling system, and so forth. This connection can be direct such as a direct electrical connection or the connection can be indirect such as over a network. In this way, the electrical signal may indicate that the vise is closed such as, but not limited to, by opening or closing a logic circuit. A system may receive the electrical signal indicating that the vise is closed and initiate the next step in the manufacturing process such as machining the workpiece secured in the vise.

By way of example, after completion of the machining step of the manufacturing process, the workpiece is to be removed from the jaws of the vise. To do so, pressurized fluid may be supplied to the second pressure port such that the piston actuates in the second direction configured to rotate the gear and the lead screw in the second rotational direction. A rotation of the gear in the second rotational direction causes the jaws of the vise to open and release the clamping force on the workpiece.

While the piston actuates in the second direction, the detectable mechanism or feature in the piston first end comes into proximity with the sensor disposed proximate to the housing first end. This proximity is detectable by the sensor. In response to a detection of the mechanism or feature by the sensor, the system can output an electrical signal as an indicator of the detection. A system may then receive the electrical signal indicating that the vise is open and reposition/replace the workpiece for further machining. In this manner, the fluid pressure vise actuator may then automatically repeat this process of opening and closing the vise for manufacturing a plurality of parts.

Thus, by generating and outputting electrical signals based on operation of a vise, the fluid pressure vise actuator may be integrated with existing robotic and PLC systems already implemented in manufacturing shops. In this way, the fluid pressure vise actuator is also capable of automating the vise operating aspect of CNC manufacturing which is particularly useful in automating CNC milling.

The described systems and techniques improve conventional vise operating technology by providing vise operating functionality capable of automating vise operations in existing CNC milling systems such that these existing CNC milling systems may be augmented with automated vise operation as compared to replacement of the entire milling system. In this way, the described systems are capable of automating vise operation in manufacturing environments having no other automated processes as well as in manufacturing environments that are completely automated. Additionally, the described techniques enable efficient changeover from fully automated vise operation back to conventional manual vise operation which is an important feature for machine shops that only desire vise automation in some production runs. Because the described systems and techniques automate operation of manually operated vises, machining operations utilizing the described systems will not lose clamping pressure in response to a loss of power or air pressure since manually operated vises are self-locking. This is not possible using conventional systems and techniques. Also, because the described systems mechanically rotate a lead screw of a vise, which requires less piston surface area to accomplish, the described systems require less area in a machining environment to operate the vise than conventional systems. Further, the systems and techniques described facilitate accurate and precise machining operations because the clamping force is finely adjustable in small increments even in low torque operations which is also not possible with conventional systems.

FIG. 1 is a schematic diagram illustrating an exploded view of a piston assembly 100. Piston assembly 100 may include a piston rack 102, e.g., having fixation compartments 104, piston bodies 106, 112, sensor detectable mechanisms 114, 116, piston body seals 118, 120, piston sleeves 122, 124, piston sleeve seals 126, 128, and fixation mechanisms 130, 132. In one or more embodiments, piston rack 102 may include one or more fixation compartments 104 that are configured to receive fixation mechanisms 130, 132. In some cases, piston bodies 106, 112 may include one or more sensor detectable mechanism compartments 108 and fixation holes 110. Also, piston bodies 106, 112 may include ribs that are configured to house sensor detectable mechanisms 114, 116. In one example, ribs of piston bodies 106, 112 may be configured to support the piston during actuation. Piston rack 102, piston bodies 106, 112, and piston sleeves 122, 124 may be manufactured from any suitable materials, e.g., polymers, metals, metal alloys, etc., or from any combination of suitable materials. Piston body seals 118, 120 and piston sleeve seals 126, 128 may be manufactured from polymer materials such as, but not limited to, nitrile, silicone, polytetrafluoroethylene (PTFE), and so on. Although piston rack 102 and piston bodies 106, 112 are illustrated as being separate components, in some embodiments, piston rack 102 and piston bodies 106, 112 may be integrated into a single component.

Figure 2A:
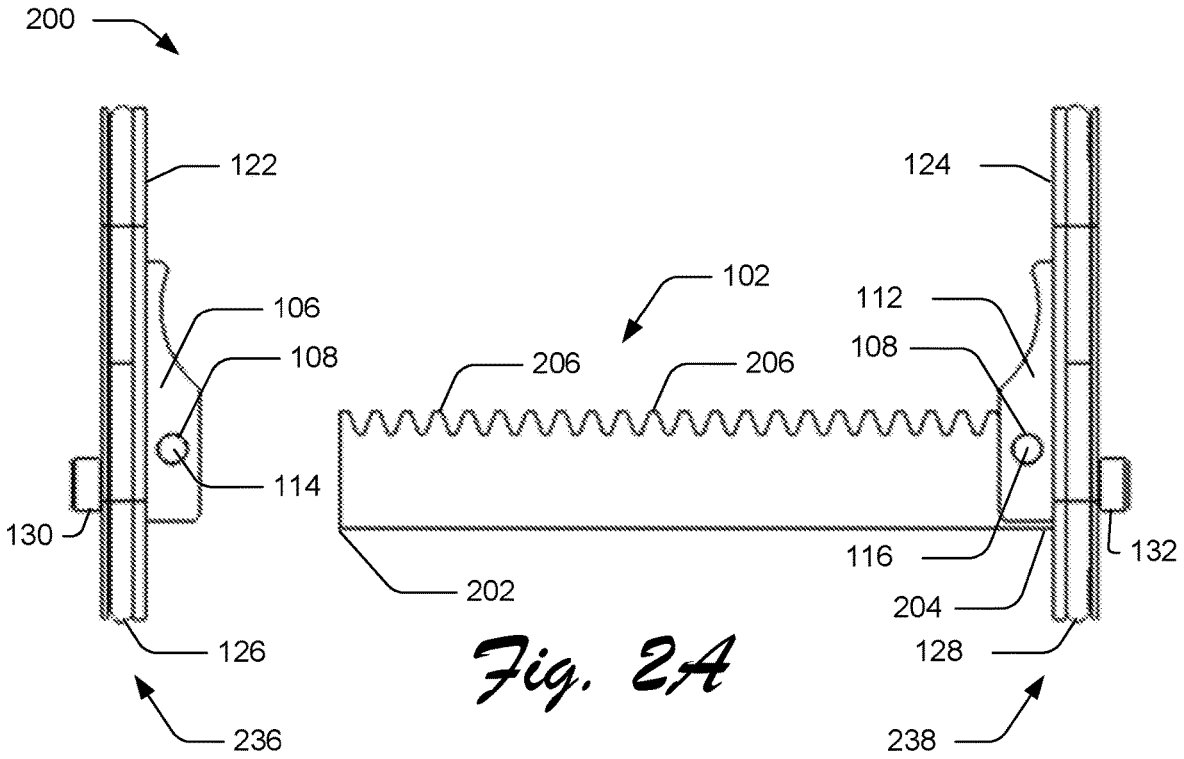
FIGS. 2A and 2B are schematic diagrams illustrating a partially assembled piston.
Figure 2B:
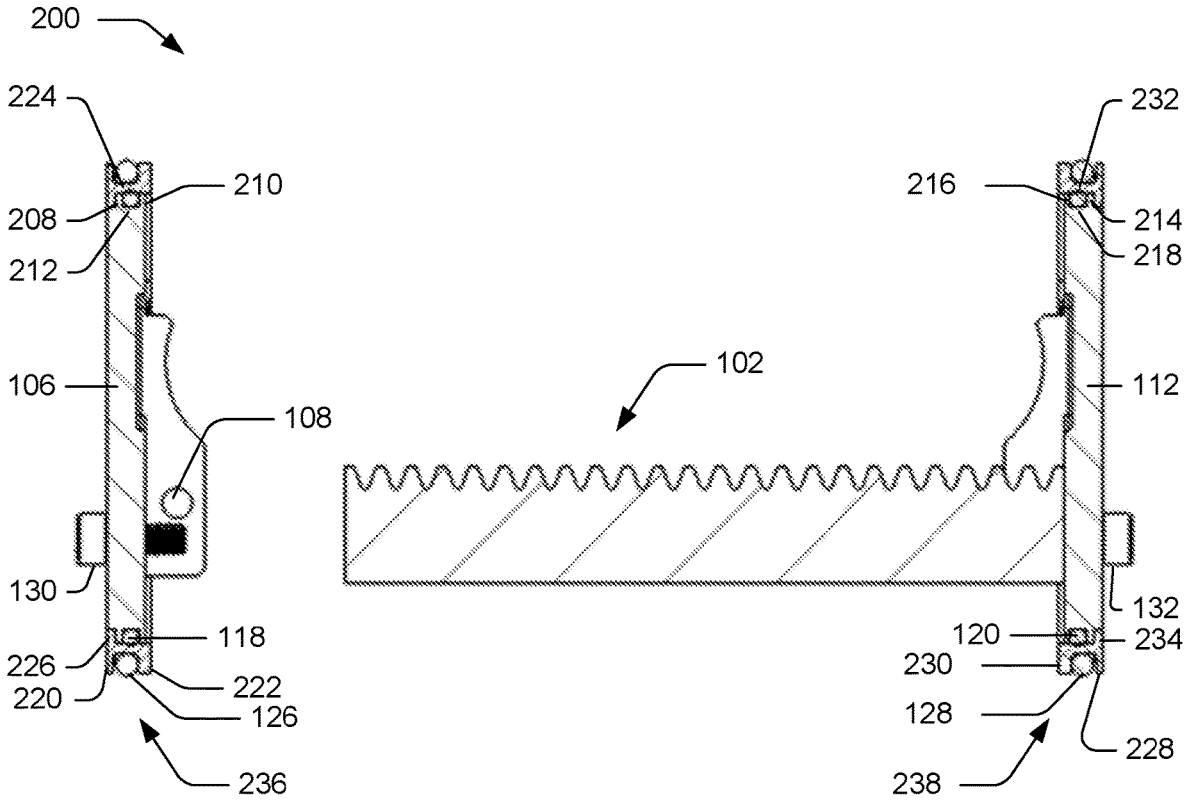

FIGS. 2A and 2B are schematic diagrams illustrating a partially assembled piston 200. FIG. 2A illustrates a front view of partially assembled piston 200 and FIG. 2B illustrates a cross-sectional view in a sagittal plane of piston 200. In one or more embodiments, one or more sensor detectable mechanisms 114 may be disposed in sensor detectable mechanism compartments 108 of piston body 106. Similarly, one or more sensor detectable mechanisms 116 may be disposed in sensor detectable mechanism compartments 108 of piston body 112. In one or more embodiments, sensor detectable mechanisms 114, 116 may be fixed in sensor detectable mechanism compartments 108 of piston body 112. For example, sensor detectable mechanisms 114, 116 may be fixed in sensor detectable mechanism compartments 108 by a friction fit, an adhesive, an epoxy, a weld, a crimp, a tie, etc.

In some examples, piston rack 102 may include a piston rack first end 202, a piston rack second end 204, and rack teeth 206. Particularly, piston rack 102 may include a smooth bearing surface on the surface opposite of rack teeth 206 that is configured to reduce friction during an actuation of piston 200. For example, the smooth bearing surface may have a surface finish with a roughness average in a range of 4 to 20 microinches. In some implementations, the smooth bearing surface may be manufactured from materials configured to reduce a force of friction during an actuation of piston 200. Piston rack first end 202 and piston rack second end 204 may also include one or more fixation compartments 104.

Further, piston 200 may comprise a piston first end 236 and a piston second end 238. Piston first end 236 may include piston body 106, sensor detectable mechanism 114, piston body seal 118, piston sleeve 122, piston sleeve seal 126, and fixation mechanisms 130. Similarly, piston second end 238 may comprise piston body 112, sensor detectable mechanism 116, piston body seal 120, piston sleeve 124, piston sleeve seal 128, and fixation mechanisms 132.

Piston first end 236 is shown in a position in which it is not attached to piston rack first end 202 by fixation mechanisms 130. For example, fixation mechanisms 130 and fixation compartments 104 may comprise screws configured to fix a portion of piston first end 236 to a portion of piston rack first end 202. In one example, fixation mechanisms 130 may include a threaded portion, e.g., having external threading, and fixation compartments 104 may include a corresponding threaded portion, e.g., having internal threading, such that a force of friction fixes fixation mechanisms 130 within fixation compartments 104. In one or more embodiments, a portion of piston first end 236 may be fixed to a portion of piston rack first end 202 by an interference fit, an adhesive, a threading, a pin, a magnet, an epoxy, a weld, and so on. Fixation mechanisms 130 are also shown disposed in fixation holes 110 of piston body 106.

As shown in FIG. 2B, piston body 106 may include a piston body first edge 208, a piston body second edge 210, and a piston body channel 212. Piston body seal 118 may be disposed around piston body 106 in piston body channel 212, e.g., between piston body first edge 208 and piston body second edge 210. In one example, example, piston body seal 118 may be elastically deformed to fit over piston body 106. Piston sleeve 122 may include a piston sleeve first edge 220, a piston sleeve second edge 222, a piston sleeve channel 224, and a piston sleeve inner edge 226. For example, at least a portion of piston body 106 and piston body seal 118 may be disposed in piston sleeve 122 such that piston body first edge 208 coincides with piston sleeve inner edge 226. Piston sleeve 122 may include tabs protruding from an inner surface such that piston body 106 snaps into place as it is disposed in piston sleeve 122. Piston sleeve seal 126 may be disposed around piston sleeve 122 in piston sleeve channel 224 between piston sleeve first edge 220 and piston sleeve second edge 222. Piston sleeve seal 126 may be elastically deformed to fit over piston sleeve 122.

As depicted in FIG. 2A, piston second end 238 is shown fixed to piston rack second end 204 by fixation mechanism 132. Fixation mechanisms 132 may be disposed in fixation holes 110 of piston body 112 and fixation compartments 104 of piston rack second end 204. For example, fixation mechanisms 132 and fixation compartments 104 may comprise screws configured to fix a portion of piston second end 238 to a portion of piston rack second end 204. In one example, fixation mechanisms 132 may include a threaded portion, e.g., having internal threading, and fixation compartments 104 may include a corresponding threaded portion, e.g., having external threading, such that a force of friction fixes fixation mechanisms 132 within fixation compartments 104. In one or more embodiments, a portion of piston second end 238 may be fixed to a portion of piston rack second end 204 by an interference fit, an adhesive, a threading, a pin, a magnet, an epoxy, a weld, and so on.

Piston body 112, as illustrated in FIG. 2B may include a piston body first edge 214, a piston body second edge 216, and a piston body channel 218. Piston body seal 120 may be disposed around piston body 112 in piston body channel 218 between piston body first edge 214 and piston body second edge 216. For example, piston body seal 120 may be elastically deformed to fit over piston body 112. Piston sleeve 124 may include a piston sleeve first edge 228, a piston sleeve second edge 230, a piston sleeve channel 232, and a piston sleeve inner edge 234. For example, at least a portion of piston body 112 and piston body seal 120 may be disposed in piston sleeve 124 such that piston body first edge 214 coincides with piston sleeve inner edge 234. Piston sleeve 124 may include tabs protruding from an inner surface such that piston body 112 snaps into place as it is disposed in piston sleeve 124. Piston sleeve seal 128 may be disposed around piston sleeve 124 in piston sleeve channel 232 between piston sleeve first edge 228 and piston sleeve second edge 230. Piston sleeve seal 128 may be elastically deformed to fit over piston sleeve 124.

Figure 3B:
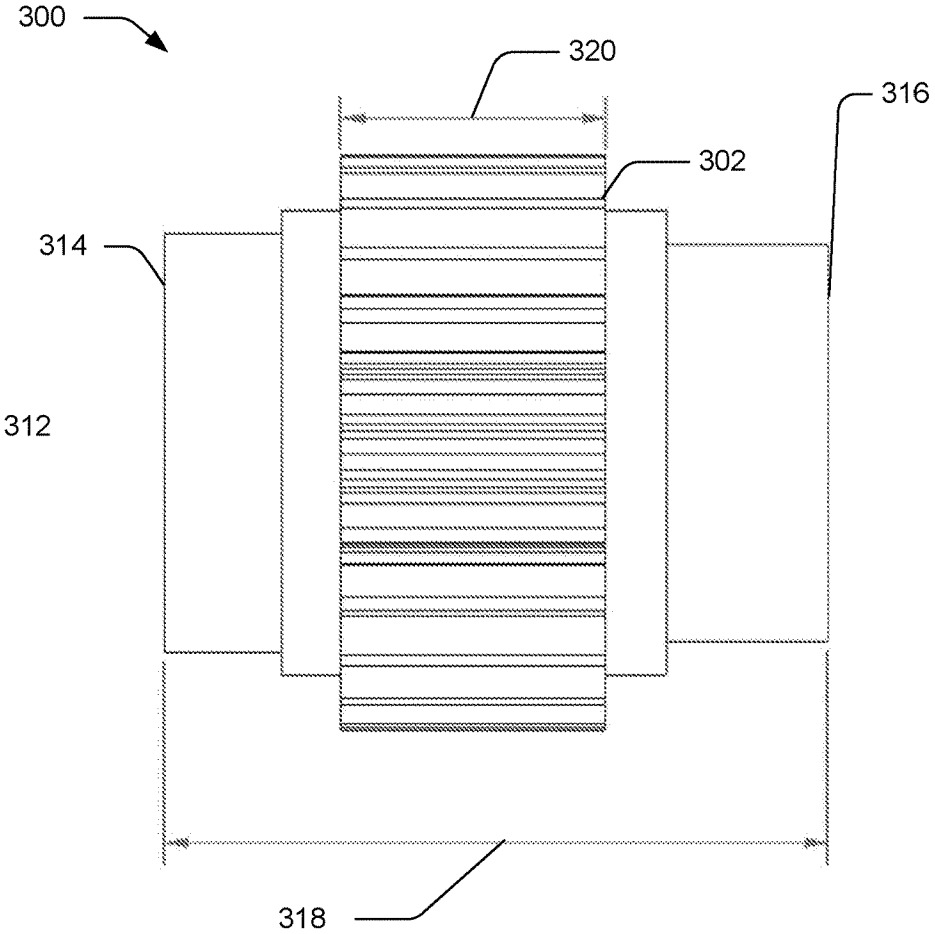
FIGS. 3A and 3B are schematic diagrams illustrating a gear.
Figure 3A:
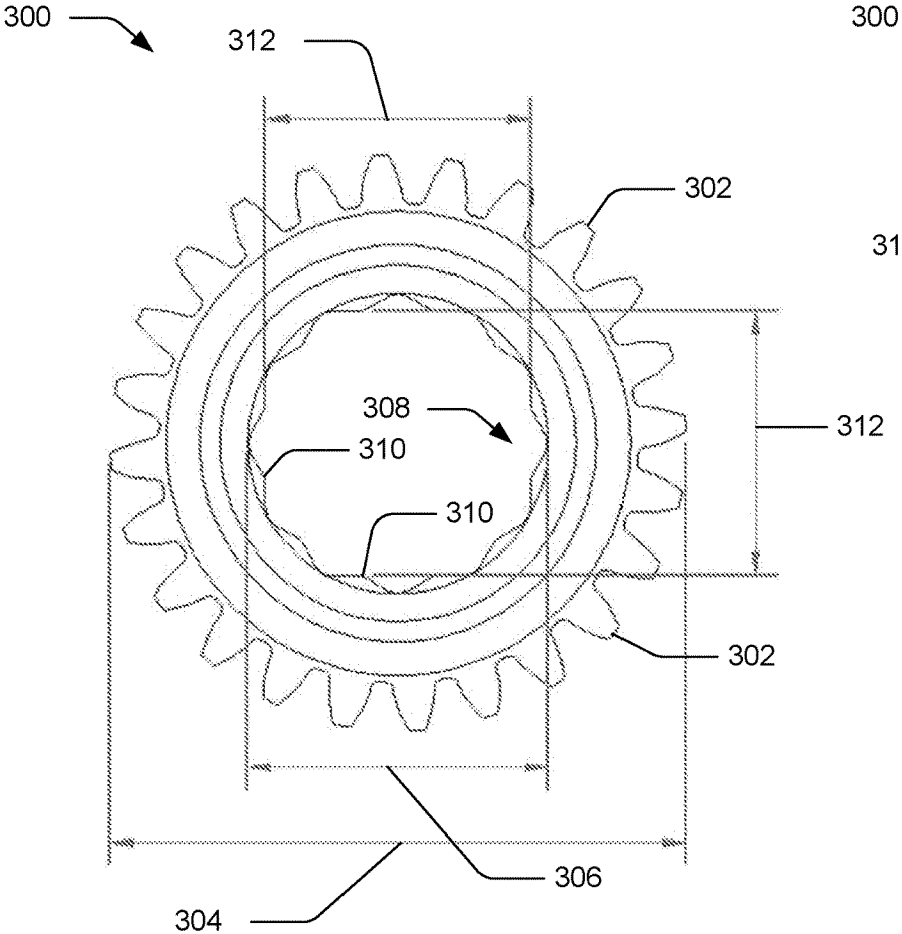

FIGS. 3A and 3B are schematic diagrams illustrating a gear 300. FIG. 3A illustrates a front view of gear 300 and FIG. 3B illustrates a side view of gear 300. Gear 300 may include a plurality of gear teeth 302. In one or more embodiments, gear teeth 302 may be configured to facilitate a force of friction, for example, gear teeth 302 may be configured to augment a force of friction between piston rack 102 and gear 300 such that an actuation of piston rack 102 is configured to rotate gear 300. Gear 300 may have dimensions including an outer diameter 304 and an inner diameter 306, a length 318, and a face width 320. In one or more embodiments, gear 300 may have a first gear end 314 and a second gear end 316. In accordance with the described systems, the gear 300 also includes socket 308.

In one example, socket 308 can include socket points 310 and a socket size 312. As shown in FIG. 3A, socket 308 is illustrated as having a particular geometry; however, socket 308 may include a plurality of different geometries that correspond to features of various vise operating mechanisms. In one or more embodiments, a geometry of socket 308 may be adjustable, e.g., socket 308 may be configured as a chuck or a clamp such as a collet which enables socket 308 to house any geometry of any vise operating mechanism. For example, socket 308 may be configured to interface with an adaptor (not shown) and the adaptor may have a geometry configured to house any vise operating mechanism. In this example, socket 308 may be configured to house and rotate the adaptor and the adaptor may be configured to house and rotate a vise operating mechanism to selectively open and/or close jaws of the vise. Accordingly, socket 308 is not limited by socket points 310 or socket size 312.

In an example in which an outer diameter of a vise operating mechanism is smaller than inner diameter 306 and/or socket size 312, socket 308 may be configured to house and rotate the vise operating mechanism by tightening a chuck, claim, or collet feature of socket 308 to decrease inner diameter 306 and/or socket size 312. In an example in which an outer diameter of a vise operating mechanism is larger than inner diameter 306 and/or socket size 312, socket 308 may be configured to indirectly house and rotate the vise operating mechanism via an adaptor. In this example, the adaptor (not shown) can have a first adaptor end and a second adaptor end such that the first adaptor end has an outer diameter configured to interface with a geometry of socket 308 and such that the second adaptor end has an outer and inner diameter configured to house and rotate the vise operating mechanism having the outer diameter that is larger than inner diameter 306 and/or socket size 312. In this manner, socket 308 may be configured to house and rotate a vise operating mechanism having an outer diameter that is larger than outer diameter 304, e.g., socket 308 may be configured to interface with and rotate the vise operating mechanism.

Gear 300 may be manufactured from any suitable materials, e.g., polymers, metals, metal alloys, etc., or from any combination of suitable materials. First gear end 314 and second gear end 316 can include smooth outer bearing surfaces to facilitate the rotation of gear 300 during an actuation of piston 200. Socket 308 is located through a hollow center of gear 300 such that socket 308 can house a lead screw of a vise, for example, socket 308 may be configured to house and rotate a lead screw head to rotate the lead screw and operate the vise. In one or more embodiments, gear 300 may include a number of gear teeth in a range of 16 to 28 gear teeth 302. However, in some examples gear 300 may include less than 16 gear teeth 302 or more than 28 gear teeth 302. Inner diameter 306 may include socket 308. As shown, socket 308 may include 12 socket points 310. However, in some cases, socket 308 may have less than 12 socket points 310 or more than 12 socket points 310.

In one or more embodiments, socket 308 may house, interlock with, or interface with a lead screw of a vise. For example, socket 308 may have a geometry configured to interface with a hex portion of a lead screw such that independent rotational motion between the lead screw and socket 308 is temporarily prevented while the lead screw is disposed within socket 308. In this way, a rotation of gear 300 and a corresponding rotation of socket 308 is configured to rotate the lead screw. Thus, by rotating the lead screw of the vise, the fluid pressure vise actuator is configured to operate the vise such that jaws of the vise may be selectively opened or closed.

Figure 4A:
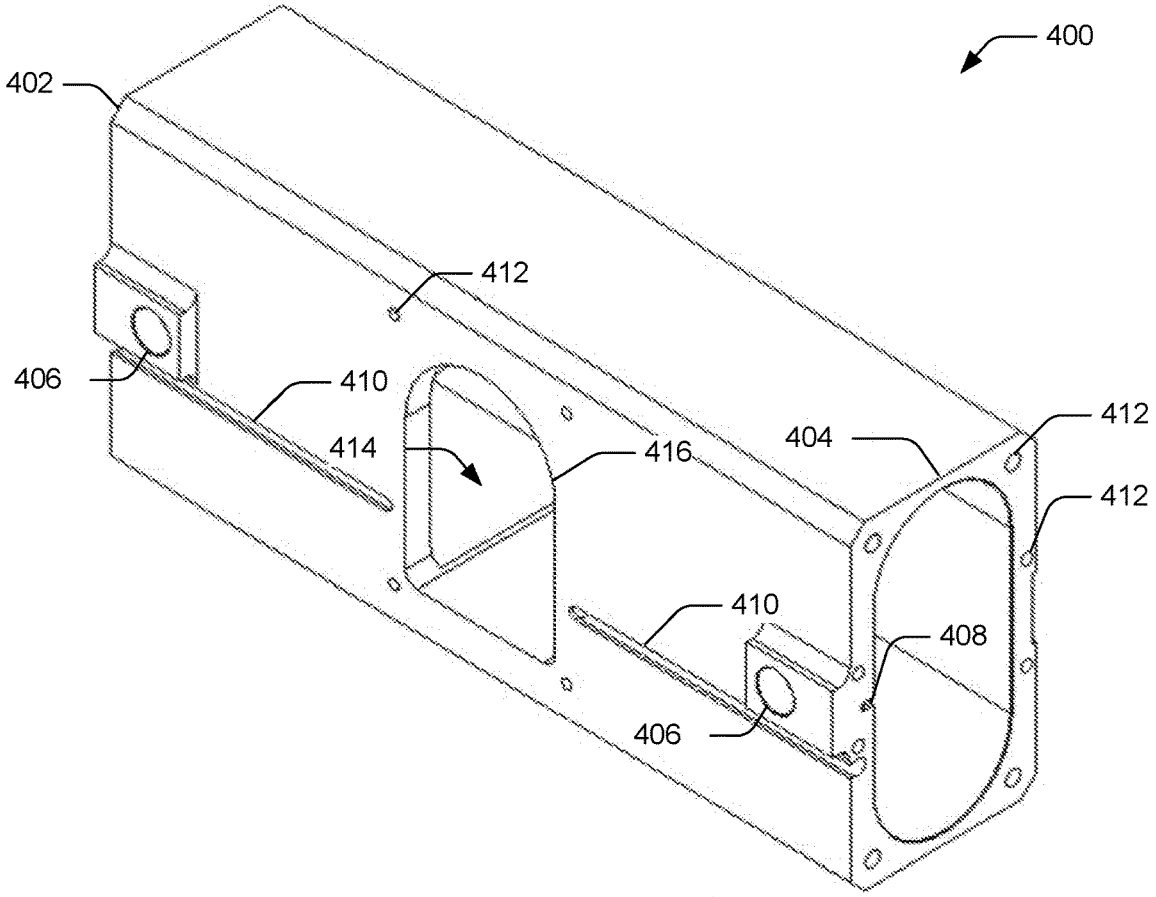
FIGS. 4A and 4B are schematic diagrams illustrating a housing.
Figure 4B:
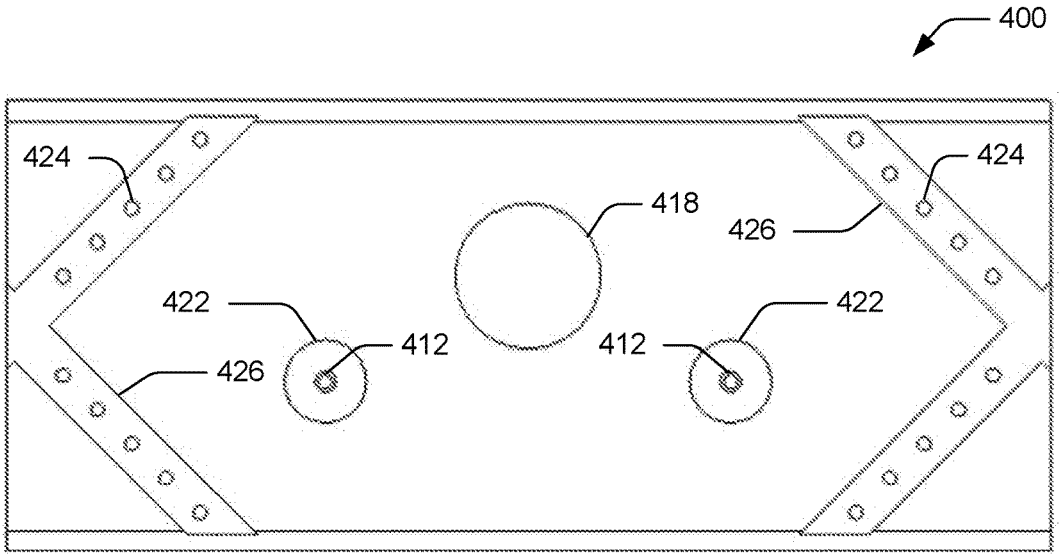

FIGS. 4A and 4B are schematic diagrams illustrating a housing 400. FIG. 4A illustrates an isometric view of housing 400 and FIG. 4B illustrates a back view of housing 400. Housing 400 may be manufactured from any suitable materials, e.g., polymers, metals, metal alloys, etc., or from any combination of suitable materials. Housing 400 may include a housing first end 402 and a housing second end 404. In one or more embodiments, housing 400 may include pneumatic fitting ports 406, sensor ports 410, receiving ends 412 of fixation mechanisms, an inner bore 414, an inner bore first opening 416, an inner bore second opening 418, a second opening channel (not shown), magnet compartments 422, adjustment cells 424, and grooves 426. As described herein, inner bore 414 of housing 400 corresponds to a compartment, a chamber, or a cell, etc. Inner bore 414 may be disposed between inner bore first opening 416 and inner bore second opening 418, e.g., inner bore 414 may extend between housing first end 402 and housing second end 404. Inner bore 414 may be configured to house gear 300 and a portion of piston 200. Pneumatic fitting ports 406 may include pneumatic channels 408. Pneumatic channels 408 are configured to transfer pressurized fluid such as air to and from housing 400.

Figure 5:
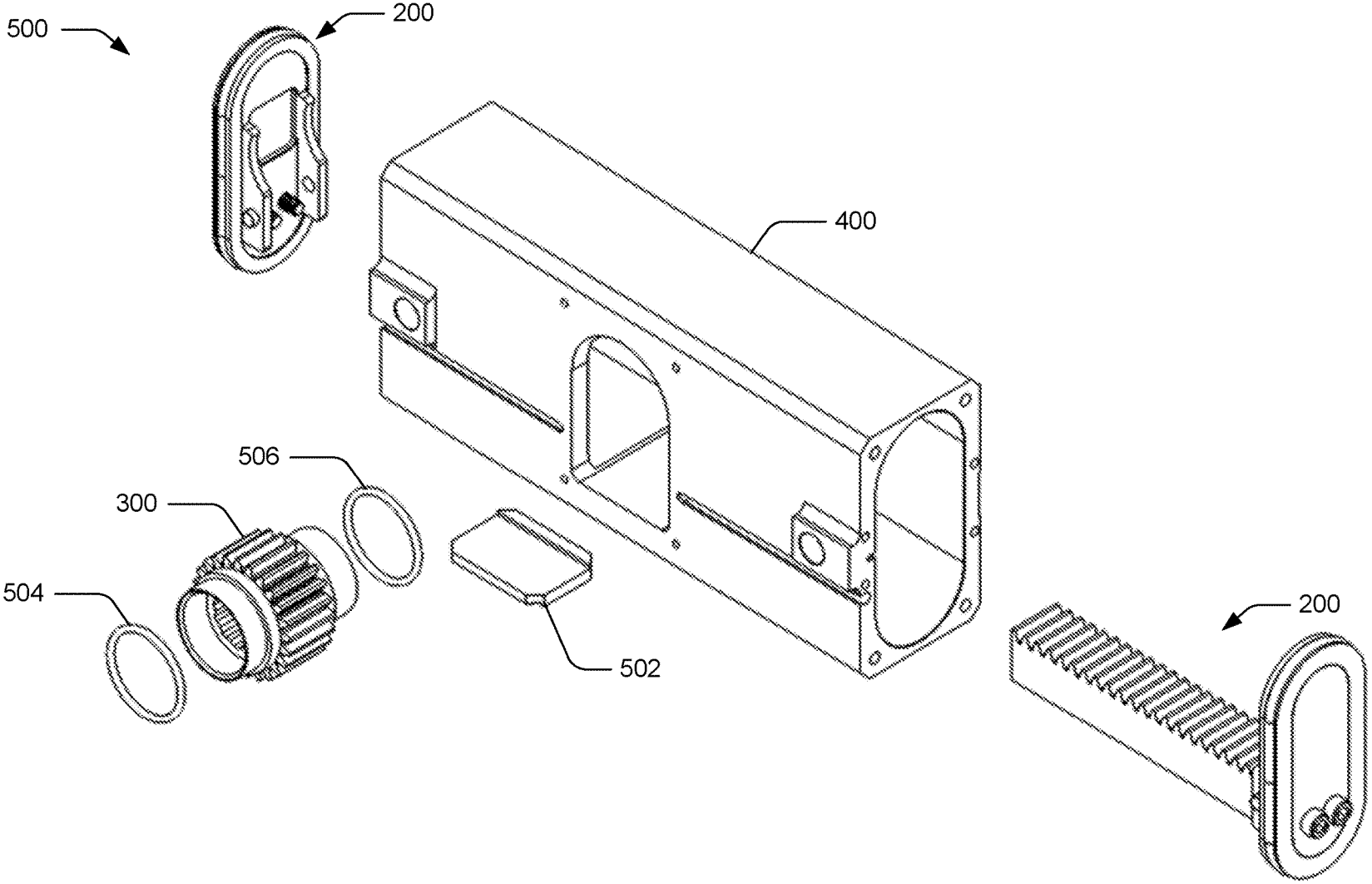
FIG. 5 is a schematic diagram illustrating an exploded view of a fluid pressure vise actuator subassembly.

FIG. 5 is a schematic diagram illustrating an exploded view of a fluid pressure vise actuator subassembly 500. Fluid pressure vise actuator subassembly 500 may include piston 200, gear 300, housing 400, piston guide 502, and gear seals 504, 506. In the illustrated example, these assemblies forming fluid pressure vise actuator subassembly 500 are depicted unassembled, such that piston 200, gear 300, piston guide 502, and gear seals 504, 506 are not disposed at least partially within housing 400 as during operation.

Gear seals 504, 506 are shown not disposed around first gear end 314 and second gear end 316, respectively. Illustratively, gear seal 506 may be disposed around first gear end 314. Similarly, gear seal 506 may be disposed around second gear end 316 such that gear seal 506 is contained in second opening channel (not shown) of housing 400. Gear seals 504, 506 may be manufactured from polymer materials such as, but not limited to, nitrile, silicone, polytetrafluoroethylene (PTFE), and so on.

In one or more embodiments, piston guide 502 may comprise at least one lip and/or channel that is configured to guide piston 200 during actuation, e.g., a portion of piston 200 may be disposed in a channel of piston guide 502. For example, the actuation of piston 200 may actuate piston 200 through a channel of piston guide 502. Piston guide 502 may comprise a flat face on one side and a smooth bearing surface on the opposite side. The smooth surface of piston guide 502 is configured to reduce friction and guide piston rack 102 during an actuation of piston 200. Piston guide 502 may be manufactured from any suitable materials, e.g., polymers, metals, metal alloys, etc., or from any combination of suitable materials. For example, piston guide 502 may be manufactured from materials such as babbitt, bronze, nylon, acetal, polyetheretherketone (PEEK), polytetrafluoroethylene (PTFE), vespel, and so on. In one example, a material of a portion of piston guide 502 and a material of a portion of piston 200 may be configured to minimize a coefficient of friction between the portion of piston guide 502 and the portion of piston 200. For example, the portion of piston guide 502 may be manufactured from non-crystalline material such as glass and the portion of piston 200 may be manufactured from carbon or a carbon allotrope such as graphite. In another example, the portion of piston guide 502 and the portion of piston 200 may be coated with a material, e.g., Teflon, configured to reduce a force of friction between the portion of piston guide 502 and the portion of piston 200. In some examples, a lubricant material may be disposed between the portion of piston guide 502 and the portion of the piston 200 to reduce friction between the portion of piston guide 502 and the portion of piston 200.

Figure 6A:
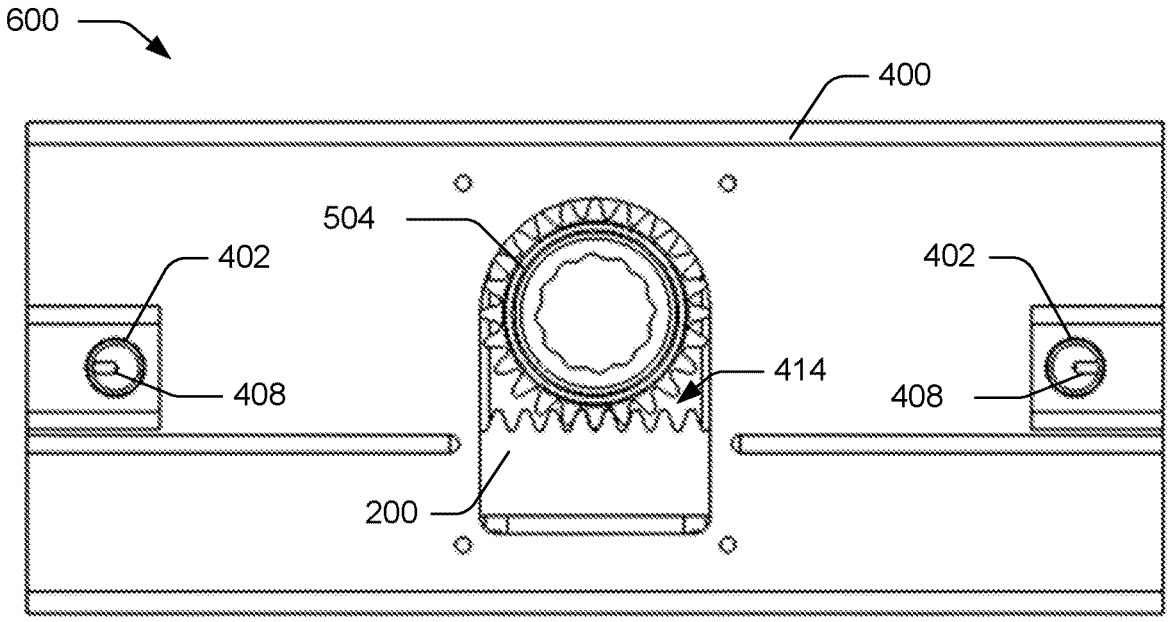
FIGS. 6A and 6B are schematic diagrams illustrating an assembled fluid pressure vise actuator subassembly.
Figure 6B:
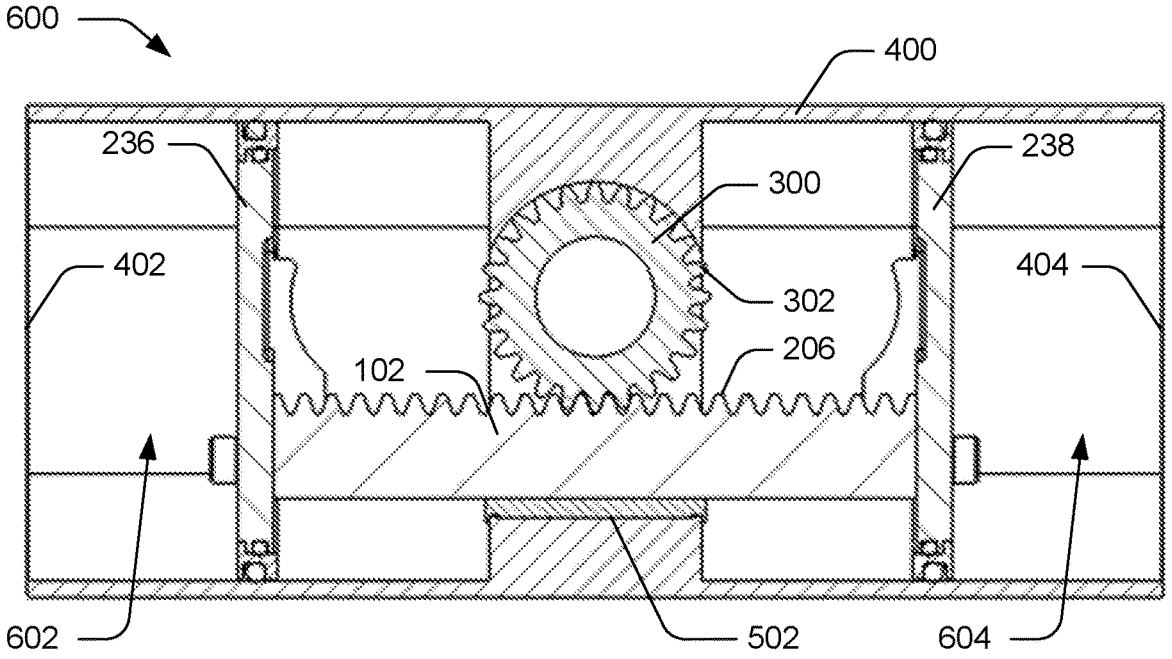

FIGS. 6A and 6B are schematic diagrams illustrating an assembled fluid pressure vise actuator subassembly 600. FIG. 6A illustrates a front view of assembled fluid pressure vise actuator subassembly 600. This front view depicts pneumatic fitting ports 406 from a different perspective than FIG. 4, and further depicts include pneumatic channels 408 which are configured as pathways for pressurized fluid to transfer to and from housing 400.

FIG. 6B illustrates a cross-section view in a frontal plane of assembled fluid pressure vise actuator subassembly 600. As depicted in this view, inner bore 414 of housing 400 enables it to house gear 300, a portion of piston 200, and piston guide 502. First chamber 602 of housing 400 may be disposed between inner bore 414 and housing first end 402. Second chamber 604 of housing 400 may be disposed between inner bore 414 and housing second end 404. Further, housing 400 may house piston 200 such that piston first end 236 is contained in first chamber 602 and piston second end 238 is contained in second chamber 604. In one example, first chamber 602 and second chamber 604 may be stadium cylinders. In some cases, first chamber 602 and second chamber 604 may be cylinders such as, but not limited to, rectangular, polygonal, or circular cylinders.

As shown in FIG. 6B, piston 200 may be disposed in housing 400 such that piston sleeve seal 126 of piston first end 236 coincides with a surface of first chamber 602 and piston sleeve seal 128 of piston second end 238 coincides with a surface of second chamber 604. In some cases, piston sleeve seals 126, 128 may abut, be adjacent to, and/or contact a surface of first chamber 602 and second chamber 604, respectively. In this way, piston 200 is sealed within first chamber 602 and second chamber 604 by sleeve seals 126, 128, respectively. For example, piston 200 may be hermetically sealed in first chamber and second chamber 604. In one or more embodiments, piston sleeve seal 126 and piston body seal 118 may interact to center piston first end 236 in first chamber 602. Similarly, piston sleeve seal 128 and piston body seal 120 can interact to center piston second end 238 in second chamber 604. In this way, piston first end 236 and piston second end 238 may remain centered in housing 400 during an actuation of piston 200.

Further, piston 200 may be disposed in housing 400 such that a portion of the smooth bearing surface of piston rack 102 is adjacent to piston guide 502 and a portion piston rack 102 is adjacent to a portion of gear 300. In some cases, a portion of rack teeth 206 mesh with a portion of gear teeth 302. For example, piston guide 502 may be disposed in a pocket of inner bore 414 wherein the smooth bearing surface and the protruding lips of piston guide 502 are adjacent to a portion of piston rack 102. Notably, a portion of piston rack 200 may be disposed in a channel of piston guide 502 to reduce friction caused during an actuation of piston 200. As shown in FIG. 6B, piston guide 502 may also guide piston rack 102 in housing 400 during an actuation of piston 200. Additionally, gear 300 may be fully or partially disposed in inner bore 414 such that second gear end 316 is concentric with inner bore second opening 418.

Figure 7B:
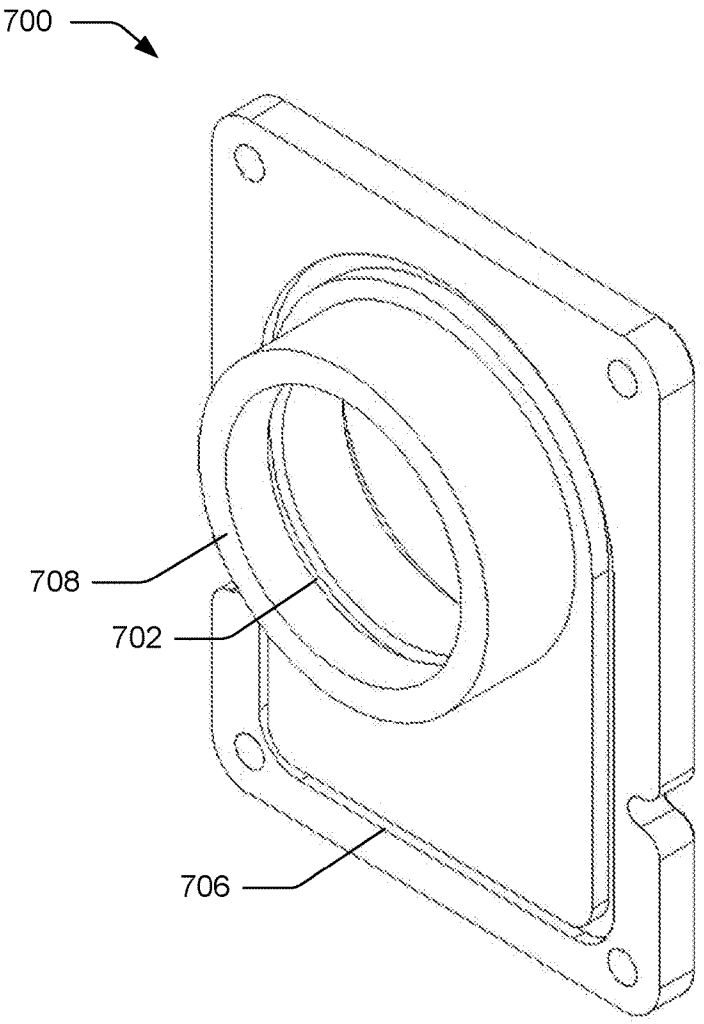
FIGS. 7A and 7B are schematic diagrams illustrating an inner bore cover.
Figure 7A:
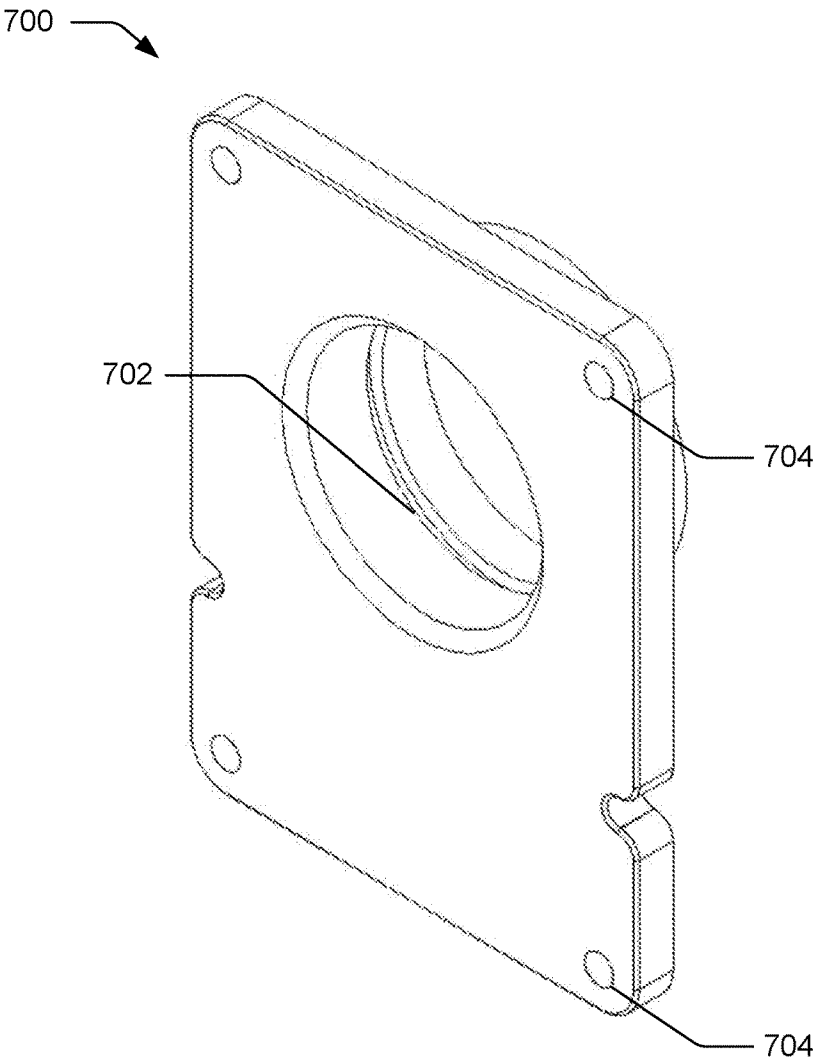

FIGS. 7A and 7B are schematic diagrams illustrating an inner bore cover 700. FIG. 7A illustrates an isometric view of the front of inner bore cover 700 and FIG. 7B illustrates an isometric view of the back of inner bore cover 700. Inner bore cover 700 may comprise a channel 702, fixation holes 704, channel 706, and aperture 708. Inner bore cover 700 may be manufactured from any suitable materials, e.g., polymers, metals, metal alloys, etc., or from any combination of suitable materials.

Figure 8B:
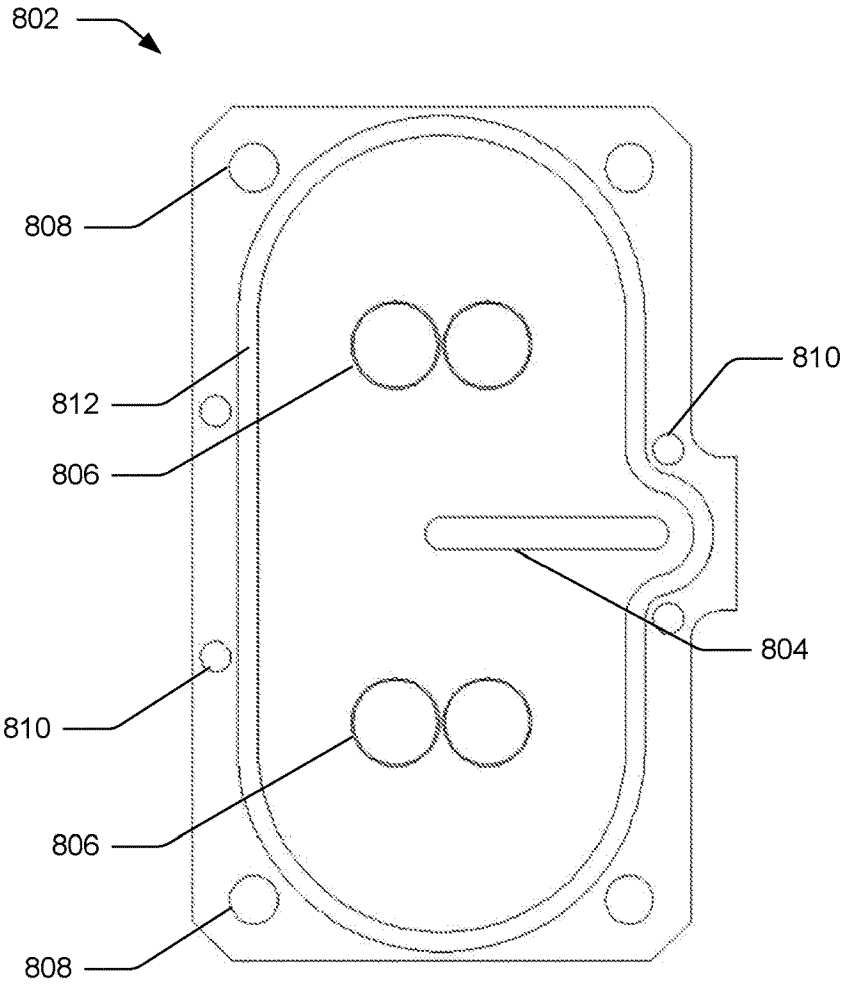
FIGS. 8A and 8B are schematic diagrams illustrating endcaps.
Figure 8A:
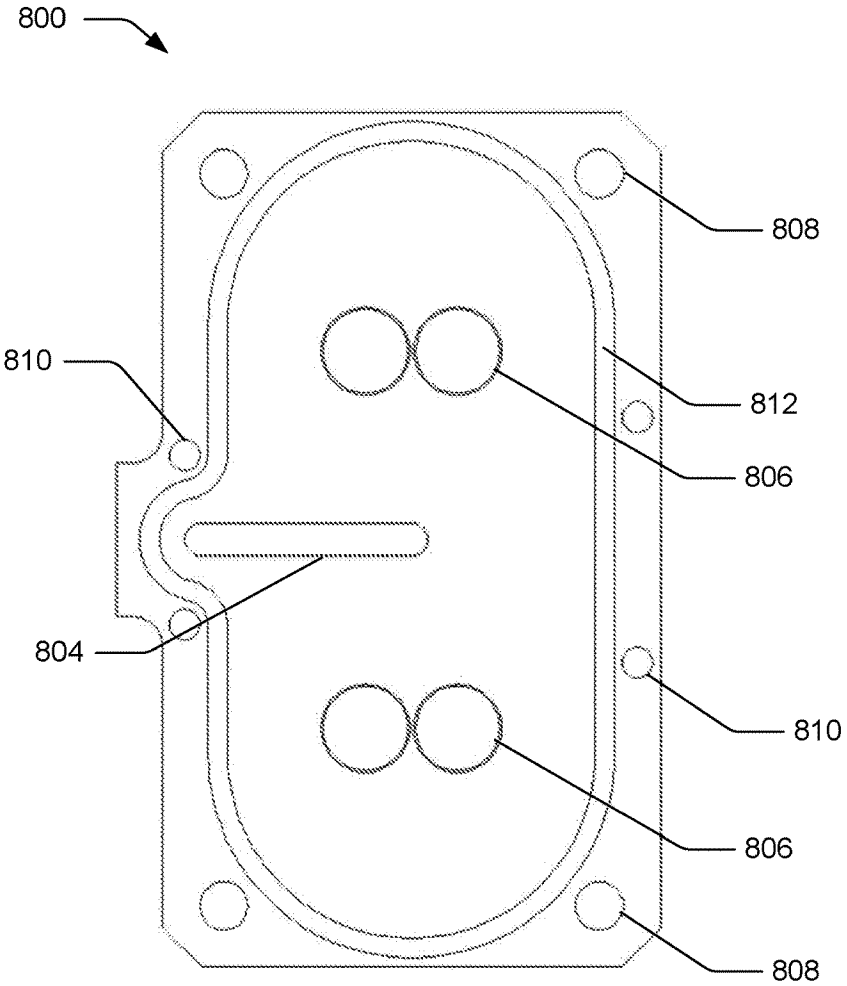

FIGS. 8A and 8B are schematic diagrams illustrating a first endcap 800 and a second endcap 802. As depicted in FIG. 8A, first endcap 800 may comprise pneumatic channel 804, compartments 806, fixation holes 808, 810, and channel 812. Similarly, as depicted in FIG. 8B, second endcap 802 may comprise pneumatic channel 804, compartments 806, fixation holes 808, 810, and channel 812. First endcap 800 and second endcap 802 may be manufactured from any suitable materials, e.g., polymers, metals, metal alloys, etc., or from any combination of suitable materials. Further, pneumatic channels 804 of first endcap 800 and second endcap 802 may connect a pathway between pneumatic channels 408 of housing 400 to transfer pressurized fluid such as air to and from housing 400.

Figure 9:
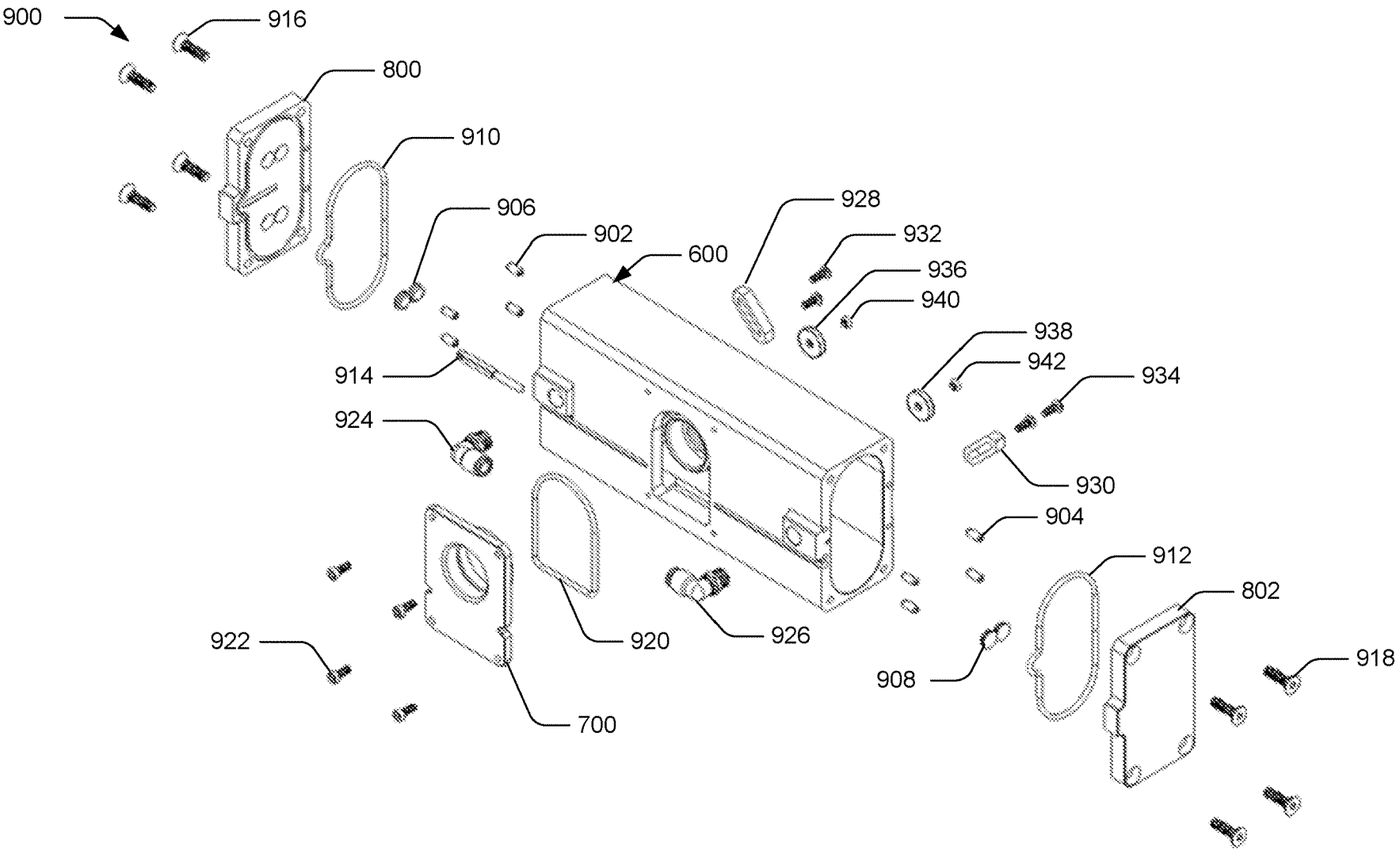
FIG. 9 is a schematic diagram illustrating an exploded view of a fluid pressure vise actuator assembly.

FIG. 9 is a schematic diagram illustrating an exploded view of a fluid pressure vise actuator assembly 900. Fluid pressure vise actuator assembly 900 may include assembled fluid pressure vise actuator subassembly 600; fixation mechanisms 902, 904, 916, 918, 922, 932, 934, 940, 942; dampers 906, 908; endcap seals 910, 912; sensor 914; first endcap 800; second endcap 802; an inner bore cover seal 920; inner bore cover 700; pneumatic fittings 924, 926; clamping blocks 928, 930; and magnets 936, 938. Clamping blocks 928, 930 may be manufactured from any suitable materials, e.g., polymers, metals, metal alloys, etc., or from any combination of suitable materials. Additionally, endcap seals 910, 912 and inner bore cover seal 920 may be manufactured from polymer materials such as, but not limited to, nitrile, silicone, polytetrafluoroethylene (PTFE), and so on.

First endcap 800 may be fixed to housing 400 by fixation mechanisms 902, 916. For example, fixation mechanisms 902, 916 and receiving ends 412 may comprise screws configured to fix a portion of first endcap 800 to a portion of housing first end 402. In one or more embodiments, a portion of first endcap 800 may be fixed to a portion of housing first end 402 by an interference fit, an adhesive, a threading, a pin, a magnet, an epoxy, a weld, and so on. Similarly, second endcap 802 may be fixed to housing 400 by fixation mechanisms 904, 918. For example, fixation mechanisms 904, 918 and receiving ends 412 may comprise screws configured to fix a portion of second endcap 802 to a portion of housing second end 404. In one or more embodiments, a portion of second endcap 802 may be fixed to a portion of housing second end 404 by an interference fit, an adhesive, a threading, a pin, a magnet, an epoxy, a weld, and so on.

Compartments 806 of first endcap 800 and second endcap 802 may contain dampers 906, 908 and house fixation mechanism 132, 130 of piston 200, respectively. Dampers 906, 908 are configured to absorb a shock of piston 200 as piston 200 fully actuates. Dampers 906, 908 may be manufactured from any shock absorbing material such as sorbothane, neoprene, rubber, and so forth. Dampers 906, 908 may also be any shock absorbing mechanisms such as, but not limited to, dampers, springs, or a combination of dampers and springs. Endcap seal 910 may be disposed in channel 812 of first endcap 800. Similarly, channel 812 of second endcap 802 may contain endcap seal 912. Also, channel 706 of inner bore cover 700 may contain inner bore cover seal 920.

Inner bore cover 700 may be fixed or attached to housing 400 by fixation mechanisms 922. For example, fixation mechanisms 922 and receiving ends 412 may comprise screws configured to fix a portion of inner bore cover 700 to a portion of inner bore first opening 416. In one or more embodiments, a portion of inner bore cover 700 may be fixed to a portion of inner bore first opening 416 by an interference fit, an adhesive, a threading, a pin, a magnet, an epoxy, a weld, and so on.

Pneumatic fittings 924, 926 may be fixed in pneumatic fitting ports 406 of housing 400. For example, pneumatic fittings 924, 926 and pneumatic fitting ports 406 may comprise screws configured to fix a portion of pneumatic fittings 924, 926 to a portion of pneumatic fitting ports 406. In one or more embodiments, a portion of pneumatic fittings 924, 926 may be fixed to a portion of pneumatic fitting ports 406 by an interference fit, an adhesive, a threading, a pin, a magnet, an epoxy, a weld, and so on. In some cases, pneumatic fittings 924, 926 may connect to a fluid supply line for supplying pressurized fluid to housing 400. For instance, pneumatic fitting 924 may be configured to provide a throughway for pressurized fluid to enter or leave the otherwise sealed first chamber 602. Similarly, pneumatic fitting 926 can be configured to provide a throughway for pressurized fluid to enter or leave the otherwise sealed second chamber 604. In one example, pneumatic fittings 924, 926 may be conduits configured to transfer pressurized fluid into housing 400 through pneumatic channels 408 of housing 400 and pneumatic channels 804 of first endcap 800 and second endcap 802, respectively. In another example, pneumatic fittings 924, 926 may transfer pressurized fluid directly into housing 400. For example, pneumatic fittings 924, 926 may be configured to connect an airline to pneumatic fitting ports 406 such that an end of the airline is disposed over a first end of pneumatic fitting 924 and/or 926. For example, a second end of pneumatic fittings 924, 926 may be disposed in pneumatic fitting ports 406 such that the second end of pneumatic fittings 924, 926, respectively may be disposed in first chamber 602 and second chamber 604.

Additionally, clamping blocks 928, 930 may be fixed in grooves 426 of housing 400 by fixation mechanisms 932, 934, respectively. For example, fixation mechanisms 932, 934 and adjustment cells 424 of housing 400 may include screws configured to fix a portion of respective clamping blocks 928, 930 to a portion of housing 400. In one or more embodiments, a portion of clamping blocks 928, 930 may be fixed to a portion of housing 400 by an interference fit, an adhesive, a threading, a pin, a magnet, an epoxy, a weld, and so on.

Further, magnets 936, 938 may be fixed to magnet compartments 422 of housing 400 by fixation mechanisms 940, 942, respectively. For example, fixation mechanisms 940, 942 and receiving ends 412 of housing 400 may include screws configured to fix a portion of respective magnets 936, 938 to a portion of magnet compartments 422. In one or more embodiments, a portion of magnets 936, 938 may be fixed to a portion of magnet compartments 422 by an interference fit, an adhesive, a threading, a pin, a magnetic force, an epoxy, a weld, and so on.

Figure 10A:
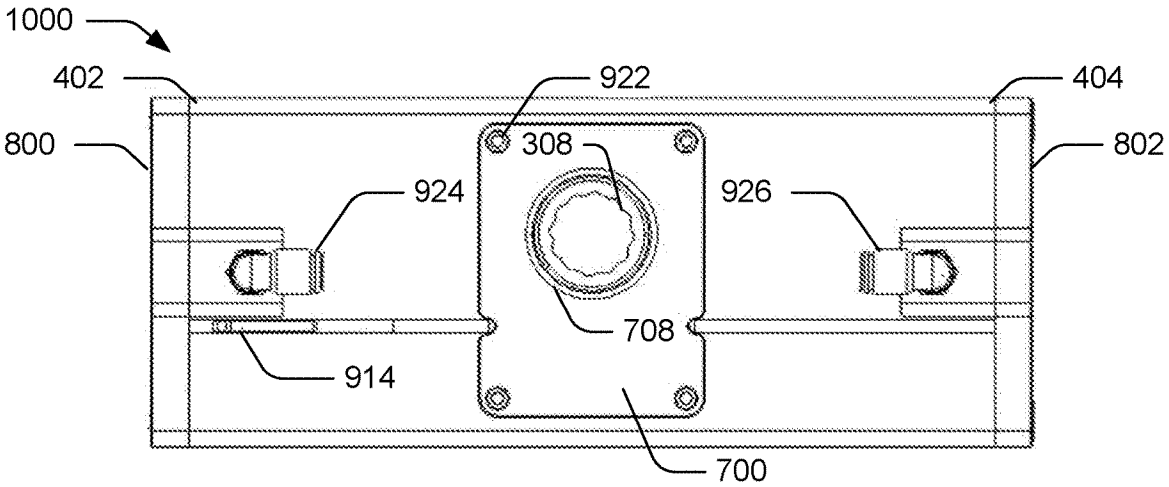
FIGS. 10A and 10B are schematic diagrams illustrating an assembled fluid pressure vise actuator.
Figure 10B:
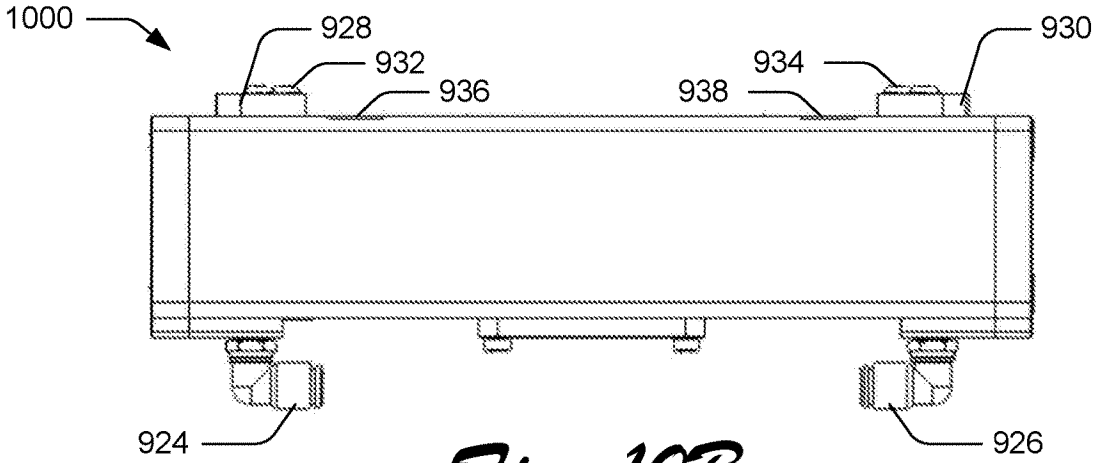

FIGS. 10A and 10B are schematic diagrams illustrating an assembled fluid pressure vise actuator 1000. FIG. 10A depicts a front view of fluid pressure vise actuator 1000. In this view, sensor 914 is disposed in sensor port 410 of housing first end 402 and may be configured to detect sensor detectable mechanisms 114 and/or 116. In one or more embodiments, two or more sensors 914 may be disposed in sensor ports 410 proximate to housing first end 402 and housing second end 404. In one example, sensor 914 may generate and output an electrical output or a signal based on the actuation of the fluid pressure vise actuator. In another example, sensors 914 may output an electrical signal in response to detecting a magnetic field of sensor detectable mechanisms 114, 116. In some cases, sensor 914 may generate and output more than one electrical signal based on detecting a magnetic field of sensor detectable mechanism 114, 116 and/or based on detecting an absence of a magnetic field.

Additionally, sensor 914 may generate and output an electric signal based on an actuation of piston 200 in a direction and may further generate and output another electric signal based on an actuation of piston 200 in another direction. In some cases, sensor 914 may generate and output an electrical signal based on an actuation of piston 200 that brings sensor detectable mechanisms 114, 116 in proximity to sensor 914. Furthermore, in one or more embodiments, sensor 914 may generate and output electrical signals and/or mechanical signals (e.g., in response to a movement of sensor 914). In one example, sensor 914 may generate and output LED signals to indicate whether the piston has actuated to close or open the vise.

In one or more embodiments, one or more sensors 914 may be connected electrically to an external system such as a robotic system, programmable logic controller (PLC) system, CNC milling system, and so forth. By doing so, sensor 914 may generate and output signals (e.g., open or close) to such external systems to further automate a manufacturing process.

As shown in FIG. 10A, first endcap 800 is fixed to housing first end 402 and second endcap 802 is fixed to housing second end 404. By fixing first endcap 800 and second endcap 802 to housing first end 402 and housing second end 404, respectively, first chamber 602 and second chamber 604 may be sealed inside of housing 400. For example, first chamber 602 and second chamber 604 may be hermetically sealed inside of housing 400. In this way, first chamber 602 and second chamber 604 are configured to receive pressurized fluid for actuating piston 200.

As also shown in FIG. 10A, inner bore cover 700 is fixed to housing 400 by fixation mechanisms 922. In this way, aperture 708 of inner bore cover 700 may expose socket 308 of gear 300 and secure gear 300 in inner bore 414. Further, inner bore cover 700 may house first gear end 314 such that first gear end 314 is concentric with aperture 708. The smooth outer surface of first gear end 314 can be housed in aperture 708 such that gear 300 is configured to rotate based on an actuation of piston 200. Aperture 708 may contain gear seal 504 in channel 702 of aperture 708, e.g., a portion of gear 300 may be disposed in aperture 708. Gear seals 504, 506 are disposed around gear 300 in channel 702 and second opening channel 420 such that gear 300 is sealed in inner bore 414 of housing 400. In this way, socket 308 of gear 300 may interface with a lead screw of a vise through inner bore second opening 418 and aperture 708.

FIG. 10B illustrates a top view of fluid pressure vise actuator 1000. As depicted in this view, clamping blocks 928, 930 may be fixed in grooves 426 of housing 400 by fixation mechanisms 932, 934, respectively. By doing so, clamping blocks 928, 930 are configured to support fluid pressure vise actuator 1000 during operation of a vise fixture. Notably, clamping blocks 928, 930 may provide anti-rotational support for fluid pressure vise actuator 1000 while operating a vise. In one or more embodiments, two or more clamping blocks 928, 930 may be fixed to housing 400. Clamping blocks 928, 930 may include beveled corners that are configured to engage with a geometry of a vise. Also, clamping blocks 928, 930 may comprise a chamfered inner lip that is configured to engage with corners of a vise fixture. Clamping blocks 928, 930 may be capable of adjusting positions on grooves 426 by adjustment cells 424 and fixation mechanisms 932, 934, respectively. Additionally, an orientation of clamping blocks 928, 930 may be adjusted to securely fix housing 400 to a vise. By doing so, fluid pressure vise actuator 1000 may be capable of fixing to a plurality of geometries and sizes of vises and/or vise fixtures by adjusting the position and/or orientation of clamping blocks 928, 930. It is to be appreciated that clamping blocks 928, 930 may be manufactured to a variety of geometries to secure housing 400 to a vise in a variety of ways without departing from the spirit or scope of the techniques described herein.

As shown in FIG. 10B, magnets 936, 938 are depicted as being fixed to magnet compartments 422 of housing 400, e.g., they may be fixed by fixation mechanisms 940, 942, respectively. Magnets 936, 938 are configured to securely fix fluid pressure vise actuator 1000 to a vise by a magnetic force between the magnets 936, 938 and the vise. By doing so, fluid pressure vise actuator 1000 may be prevented from detaching from a vise while in operation.

Figure 11:
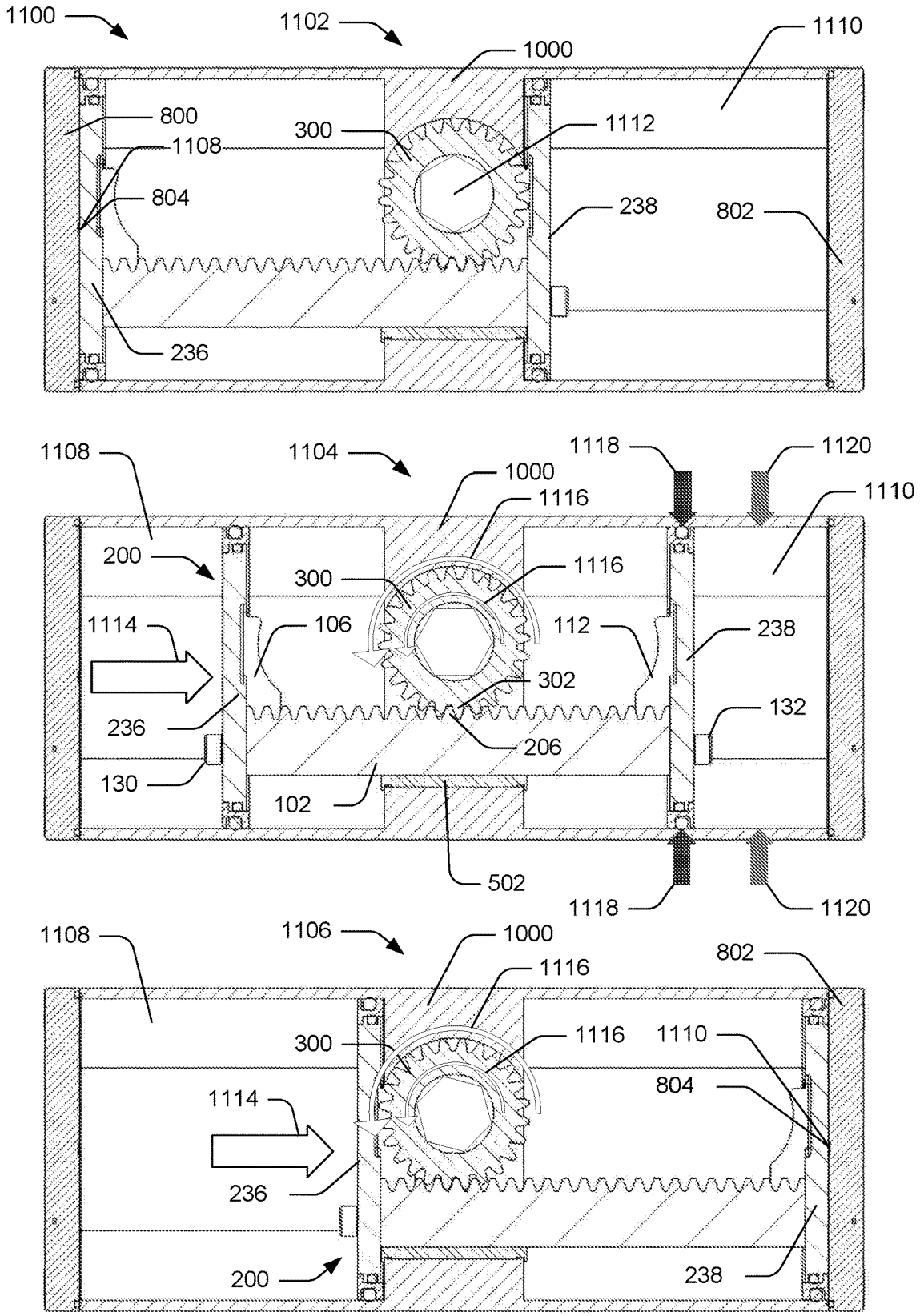
FIG. 11 is a schematic diagram illustrating an example operation of the fluid pressure vise actuator.

FIG. 11 is a schematic diagram illustrating an example operation 1100 of the fluid pressure vise actuator 1000 engaged with a lead screw 1112 of a vise. Example operation 1100 illustrates three examples of cross-sectional views in a frontal plane of fluid pressure vise actuator 1000 at 1102, 1104, and 1106. At 1102, fluid pressure vise actuator 1000 is shown in a position that may be configured to actuate where piston first end 236 coincides with first endcap 800. In one or more embodiments, piston first end 236 may abut, be adjacent to, and/or make contact with first endcap 800. Additionally, a rotational mechanism such as lead screw 1112 is interfaced with socket 308 of gear 300. In this way, a rotation of gear 300 and a corresponding rotation of socket 308 is configured to rotate lead screw 1112.

Fluid pressure vise actuator 1000 may include a first pressure port 1108 and a second pressure port 1110. First pressure port 1108 may be disposed between first endcap 800 and piston first end 236 and may receive pressurized fluid such as air to actuate piston 200 in a first direction. Similarly, second pressure port 1110 may be disposed between second endcap 802 and piston second end 238 and may receive pressurized fluid to actuate piston 200 in a second direction. In some cases, first pressure port 1108 and second pressure port 1110 of housing 400 may be formed as stadium, rectangular, polygonal, or circular cylinders. In one or more embodiments, first pressure port 1108 and/or second pressure port 1110 may receive pressurized fluid having a pressure in a range of 50 psi to 180 psi. For example, first pressure port 1108 and/or second pressure port 1110 may be configured to receive pressurized fluid having a pressure of less than 50 psi or greater than 180 psi. For example, pneumatic fittings 924, 926 may be configured to connect one or more airlines to first pressure port 1108 and/or second pressure port 1110 such that ends of the one or more airlines are disposed over a first end of pneumatic fittings 924, 926 and a second end of pneumatic fittings 924, 926 is disposed in first pressure port 1108 and second pressure port 1110.

As shown in example 1102, piston 200 may be disposed in housing 400 such that piston first end 236 coincides with a surface of first pressure port 1108 and piston second end 238 coincides with a surface of second pressure port 1110. In some cases, piston first end 236 and piston second end 238 may abut, be adjacent to, and/or contact a surface of first pressure port 1108 and second pressure port 1110, respectively.

Continuing with example 1102, first pressure port 1108 may be pressurized by transferring pressurized fluid through pneumatic channel 804 of first endcap 800 to first pressure port 1108. For example, first endcap 800 and second endcap 802 can be fixed to housing first end 402 and housing second end 404, respectively such that a supply of the pressurized fluid to housing 400 increases a magnitude of a force applied to piston first end 236 and piston second end 238, respectively. As discussed above, pressurized fluid may be supplied by a fluid pressure supply line connected to pneumatic fitting 924 that further connects to pneumatic channel 408 and pneumatic channel 804 of first endcap 800. The pressure supply line or lines may connect the first pressure port 1108 and/or second pressure port 1110 to an air compressor. In one example, the fluid pressure supply line may be connected to a pneumatic air pressure system. For instance, the fluid pressure supply line may utilize "shop" airlines commonly available in machining environments. In another example, the fluid pressure supply line or lines may be connected to a hydraulic fluid pressure system. It is to be appreciated that the fluid vise actuator 1000 may be configured to receive a plurality of pressurized fluids to actuate piston 200 in housing 400 without departing from the spirit or scope of the techniques described herein.

At 1104, fluid pressure vise actuator 1000 is shown partially actuated. In this example, pressurized fluid (not shown) that is transferred through pneumatic channel 804 causes an increase in pressure in first pressure port 1108. In or more embodiments, pressurized fluid may be regulated, adjusted, and/or supplied to fluid pressure vise actuator 1000 in connection with a robotic system. In an example, the increase in pressure in first pressure port 1108 and a depressurization of the second pressure port 1110 (e.g., opening to atmospheric pressure) may cause a force to be applied to piston first end 236 which in turn causes piston 200 to actuate in direction 1114. Piston bodies 106, 112 of piston 200 may comprise ribs that are configured to provide support to piston 200 as the force caused by an increase in pressure is applied to piston 200. Also, piston guide 502 may guide the actuation of piston rack 102. Piston guide 502 may also reduce friction between piston 200 and housing 400. In some cases, lubricants such as oils and/or greases may be applied to piston guide 502, piston rack 102, gear 300 and be disposed in housing 400 to further reduce friction during actuation of fluid pressure vise actuator.

The actuation of piston 200 in direction 1114 causes rack teeth 206 of piston rack 102 meshed with gear teeth 302 to apply a moment force on gear 300. In doing so, the moment force applied to gear 300 may cause gear 300 to rotate in a rotational direction 1116 about a center axis of gear 300. The rotation of gear 300 causes socket 308 to rotate in rotational direction 1116 and apply a torque to lead screw 1112. The torque applied to lead screw 1112 can cause lead screw 1112 to also rotate in rotational direction 1116. In some cases, an amount of actuation of piston 200 may be more or less depending upon the pressure supplied to first pressure port 804 and the torque required to rotate lead screw 1112. In one or more embodiments, fluid pressure vise actuator 1000 may actuate piston 200 based on an increase in pressure caused by a supply of pressurized fluid such as, but not limited to, air, water, oil-based hydraulic fluids, synthetic hydraulic fluids, detergent additive hydraulic fluids, and so on.

Consider an example in which a first pressure is supplied to first pressure port 1108 of housing 400 in order to operate a vise and apply a clamping force to a workpiece. The first pressure in first pressure port 1108 applies a constant first force to piston first end 238 which causes piston 200 to actuate in a first direction. The friction between gear 300 and piston 200 applies a first moment force to gear 300 which causes gear 300 to rotate in rotational direction 1116. The rotation of gear 300 then applies a first torque to lead screw 1112 disposed in socket 308. The first torque is proportional to the first moment force applied to gear 300 and may cause lead screw 1112 to rotate. A rotation of lead screw 1112 may be configured to cause jaws of the vise to close wherein the jaws make an initial contact with the workpiece. As the lead screw continues to rotate after the initial contact is made, a clamping force applied to the workpiece by the jaws increases. In this example, the first torque applied to lead screw 1112 is sufficient to rotate lead screw 1112 such that piston 200 actuates to a distance where piston second end 238 is at position 1118. At position 1118, the torque required to further rotate lead screw 1112 is greater than the first torque and as a result piston 300 ceases to actuate. Notably, by actuating piston 200 to position 1118, a resulting first clamping force is applied to the workpiece. The first pressure supplied to first pressure port 1108 correlates to the first torque applied to lead screw 1112 which also correlates to the first clamping force applied to the workpiece.

Now consider this example in which a second pressure is supplied to first pressure port 1108 to apply a clamping force. In this case, the second pressure is greater than the first pressure. As such, the second pressure applies a constant second force to piston 200 to actuate piston 200. The actuation of piston 200 applies a second moment force to gear 300 which in turn applies a second torque to lead screw 1112 of the vise. The second torque may cause lead screw 1112 to rotate and apply a second clamping force on the workpiece. However, because the second pressure supplied is greater than the first pressure, the second torque applied to lead screw 1112 is greater than the first torque. Because of this, lead screw 1112 is rotated such that piston 200 actuates to a distance where piston second end 238 is at position 1120. Notably, using the second pressure, piston 200 actuates further in direction 1114 than piston 200 actuates using the first pressure. At position 1120, the torque required to further rotate lead screw 1112 may be greater than the second torque and as a result piston 300 ceases to actuate. By actuating piston 200 to position 1120, a resulting second clamping force is applied to the workpiece. The second pressure supplied to first pressure port 1108 correlates to the second torque applied to lead screw 1112 which also correlates to the second clamping force applied to the workpiece in this example. Accordingly, the second clamping force may be greater than the first clamping force described above.

In this way, fluid pressure vise actuator 1000 is configured to adjust the clamping force applied to a workpiece by adjusting a pressure supplied to first pressure port 1108 or second pressure port 1110. For example, the supplied pressurized fluid may be adjusted in connection with a pressure regulator. In some cases, a pressure regulator is configured to provide less pressure to the pressure port that actuates piston 200 to close the vise than to the pressure port that actuates piston 200 to open the vise. In this way, the vise may not be stuck in the closed state due to an additional breakaway pressure needed to actuate piston 200 to open the vise. Further, by consistently applying a same pressure to first pressure port 1108 or second pressure port 1110 during operation of a vise, a consistent clamping force may be achieved while manufacturing a plurality of parts. Also, by applying a consistent pressure to first pressure port 1108 or second pressure port 1110, fluid pressure vise actuator 1000 is also configured to consistently open the vise a same amount while manufacturing a plurality of parts.

Continuing with the example in which the first pressure supplied causes the first clamping force to be applied to the workpiece. Consider an instance in which a pressure failure results in a loss of the supplied first pressure. The loss of the first pressure subsequently results in a loss of the first force applied to piston 200, the first moment on gear 300, and the first torque on lead screw 1112. However, the loss of the first pressure does not result in a loss of the first clamping force. This is because in general, a lead screw of a vise does not rotate to open or close the jaws of the vise without a sufficient torque being applied to the lead screw. So in this case, the loss of the first torque on lead screw 1112 still maintains the first clamping force because there is not a sufficient opposing torque applied to lead screw 1112 to rotate lead screw 1112 and open the vise. In this way, fluid pressure vise actuator 1000 is configured to maintain a constant clamping force on a workpiece in the case of pressure failure. In contrast, conventional systems that utilize fluid pressure failsafe to maintain a clamping force in the event of pressure failure because conventional systems directly apply a clamping force on the vise.

In one example, the fluid pressure lines configured to supply pressurized fluid to fluid pressure vise actuator 1000 may be "shop" fluid pressure lines commonly available in machining environments. In some cases, the fluid pressure supply lines configured to supply pressurized fluid to the fluid pressure vise actuator 1000 may be regulated and adjusted in connection with a robotic system and/or a CNC milling system. In some cases, the fluid pressure supply lines may be configured to alternately supply pressurized fluid to a pressure port and to depressurize another pressure port of the fluid pressure vise actuator. Such supply may be regulated and adjusted in connection with a robotic system and CNC milling systems. For example, robotic and CNC milling systems may generate and output electrical signals in connection with pressure control valves to control the supply and release of pressurized fluid in fluid pressure vise actuator 1000. In one or more embodiments, fluid pressure lines configured to supply pressurized fluid to first pressure port 1108 and second pressure port 1110 may be alternately pressurized and released to atmospheric pressure in connection with one or more control valves such as, but not limited to, electromechanical control valves, four-way two or three position valves, five-way two or three position valves, pneumatic control valves, hydraulic control valves, and so forth. For example, by controlling fluid pressure supply with a four or five way two or three position value a supplied pressure in first pressure port 1108 or second pressure port 1110 (and thus a clamping force) may be maintained in the event that fluid pressure supply to the control valve is lost and/or electrical power is lost. In this way, fluid pressure vise actuator 1000 may be configured to operate a vise in connection with robotic and CNC milling systems to further automate the manufacturing process.

At 1106, fluid pressure vise actuator 1000 is shown in a position where piston 200 may be fully actuated such that piston second end 238 coincides with second endcap 802. In other examples, piston second end 238 may abut, be adjacent to, and/or make contact with second endcap 802. In some examples, an actuation of piston 200 causes piston second end 236 to approach second endcap 802 such that an initial contact may be made between fixation mechanisms 132 and dampers 908 contained in compartments 806 of second endcap 802. In this way, dampers 908 may slow the actuation of piston 200 to a stop as dampers 908 absorb the force and stress from an impact of piston 200.

It is to be appreciated piston 200 may also actuate in a direction opposite of direction 1114 by increasing pressure in second pressure port 1110 and depressurizing first pressure port 1108, and as a result, can rotate gear 300 in a rotational direction opposite rotational direction 1116. The actuation of fluid pressure vise actuator 1000 in either direction may open or close jaws of the vise by rotating the lead screw. For example, an actuation of piston 200 in direction 1114 caused by increasing a pressure in first pressure port 1108 may open or close a vise by rotating lead screw 1112 in rotational direction 1116. Similarly, an actuation of piston 200 in a direction opposite of direction 1114 caused by increasing a pressure in second pressure port 1110 may close or open the vise by rotating the lead screw in a rotational direction opposite rotational direction 1116.

Thus, fluid pressure vise actuator 1000 may open and close a vise and as a result, clamp and unclamp a workpiece in a machining process. By doing so, fluid pressure vise actuator 1000 may further automate the manufacturing process by clamping and unclamping workpieces in a vise to augment a robot or workpiece handling system that loads unfinished and unloads finished workpieces.

It is also beneficial in an automated manufacturing process such as described above, to provide feedback to ensure that each step of the process has been initiated and/or completed successfully. Consider an example in which piston first end 236 and piston second end 238 each include sensor detectable mechanisms 114 and housing 400 includes first sensor 914 in sensor port 410 proximate to housing first end 402 and a second sensor 914 in sensor port 410 proximate to housing second end 404. Pressurized fluid may be supplied to first pressure port 1108 while second pressure port 1110 can be released to atmospheric pressure. The increase in pressure in first pressure port 1108 causes piston 200 to actuate in direction 1114 which then causes gear 300 to rotate in rotational direction 1116. The rotation of gear 300 rotates lead screw 1112 disposed in socket 308. The rotation of lead screw 1112 can cause jaws of a vise to close and apply a clamping force to a workpiece. While piston 200 actuates in direction 1114, piston second end 238 and therefore sensor detectable mechanism 114 included in piston second end 238 comes into proximity with second sensor 914 proximate to housing second end 404. This proximity may cause second sensor 914 to generate and output an electrical signal. In one or more embodiments, sensors 914 may be electrically connected or wirelessly connected via a network to an external system such as a robotic system, programmable logic controller (PLC) system, CNC milling system, and so forth. The electrical signal generated and output by sensor 914 may indicate that the vise is closed. A system may receive the electrical signal indicating that the vise is closed and initiate the next step in the manufacturing process such as machining the workpiece secured in the vise.

By way of example, after completion of the machining step of the manufacturing process, the workpiece is to be removed. To do so, pressurized fluid is supplied to second pressure port 1110 while first pressure port 1108 is released to atmospheric pressure. The increase in pressure in second pressure port 1110 can cause piston 200 to actuate in the direction opposite direction 1114 which then causes the gear to rotate in a rotational direction opposite rotational direction 1116. The rotation of the gear in the rotational direction opposite rotational direction 1116 rotates lead screw 1112 disposed in socket 308 of gear 300. The rotation of lead screw 1112 causes the jaws of the vise to open and release the clamping force on the workpiece. While piston 200 actuates in the direction opposite direction 1114, piston first end 236 and therefore sensor detectable mechanism 114 included in piston first end 236 comes into proximity with first sensor 914 proximate housing first end 402. This proximity can cause first sensor 914 to generate and output a signal indicating that the vise is open. A system may then receive the signal that the vise is open and reposition/replace the workpiece for further machining. Fluid pressure vise actuator 1000 may then repeat this process of opening and closing the vise for manufacturing a plurality of parts.

Thus, fluid pressure vise actuator 1000 may provide useful information to a controlling unit such as a robot by outputting signals indicating the completion of clamping and unclamping a workpiece held in a vise. By doing so, fluid pressure vise actuator 1000 may be integrated with existing robotic and PLC systems to further automate the machining process and is capable of automating the vise operating aspect of CNC manufacturing.

Figure 12B:
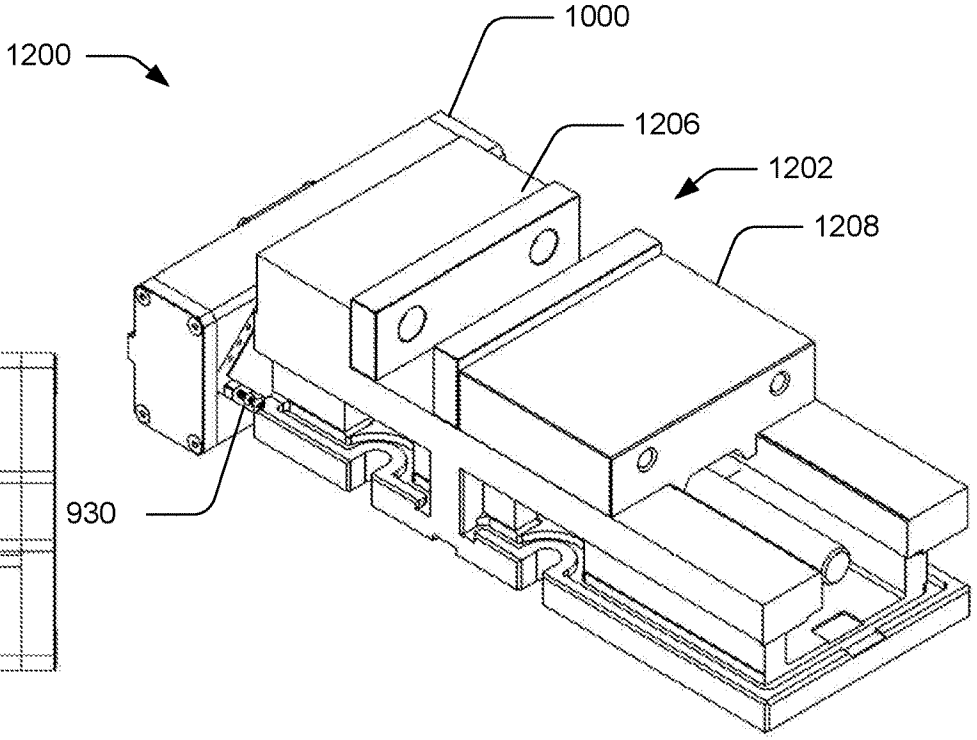
FIGS. 12A and 12B are schematic diagrams illustrating a fluid pressure vise actuator fixed to a vise for operation.
Figure 12A:
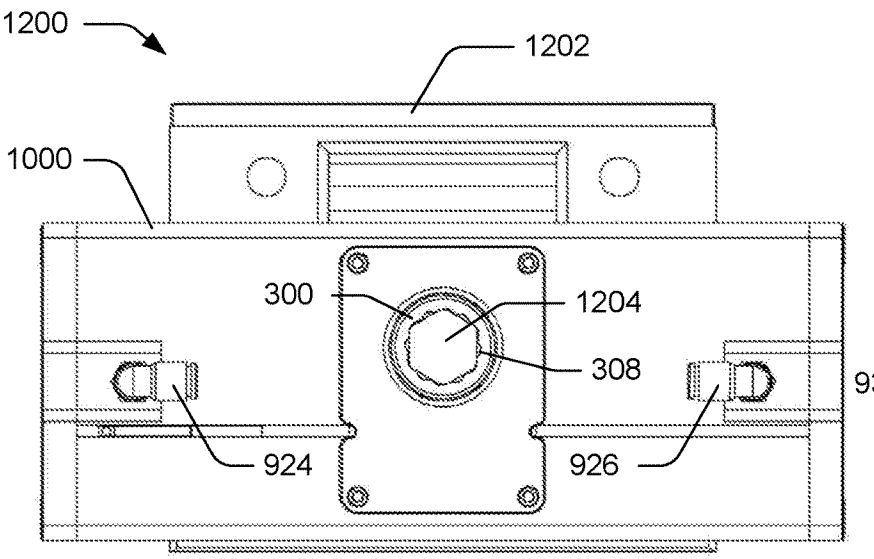

FIGS. 12A and 12B are schematic diagrams 1200 illustrating fluid pressure vise actuator 1000 fixed to a vise 1202 for operation. Vise 1202 may include a lead screw 1204, a stationary jaw 1206, and an adjustable jaw 1208. The rotation of lead screw 1204 may open and close vise 1202 by adjusting a position of adjustable jaw 1208 relative to stationary jaw 1206. In one example, fluid pressure vise actuator 1000 may close vise 1202 by rotating lead screw 1204 and actuating adjustable jaw 1208 towards stationary jaw 1206. In another example, fluid pressure vise actuator 1000 may open vise 1202 by rotating lead screw 1204 and actuating adjustable jaw 1208 away from stationary jaw 1206.

Prior to securing fluid pressure vise actuator 1000 to vise 1202 for operation, fluid pressure vise actuator 1000 and vise 1202 may be calibrated for a workpiece. For example, before fluid pressure vise actuator 1000 is secured to vise 1202, fluid pressure vise actuator may be connected to fluid pressure lines by pneumatic fittings 924, 926. The fluid pressure lines may be configured to supply pressurized fluid to first pressure port 1108 and second pressure port 1110. Pressurized fluid can be supplied to first pressure port 1108 or second pressure port 1110 such that piston 200 fully actuates in a direction that is configured to open jaws of vise 1202 when fluid pressure vise actuator 1000 is secured to vise 1202.

Also, before fluid vise actuator 1000 is secured to vise 1202, a user may rotate lead screw 1204 manually (e.g., with a wrench) such that adjustable jaw 1208 moves toward the workpiece and stationary jaw 1206. The user continues rotating lead screw 1204 until a desired clamping force on the workpiece is achieved. Once this occurs, the user rotates lead screw 1204 in a range of 90 to 270 degrees in a rotational direction to open vise 1202 and position adjustable jaw 1208 a distance away from stationary jaw 1206. In this way, vise 1202 is calibrated such that when fluid pressure vise actuator 1000 is secured to vise 1202, fluid pressure vise actuator 1000 may consistently open vise 1202 and position adjustable jaw 1208 the same distance away from stationary jaw 1206. By doing so, when fluid pressure vise actuator 1000 is secured to vise 1202, a less than full actuation of piston 200 in a direction that closes the vise may result in the desired clamping force. This also allows for the clamping force to be further adjusted by adjusting the supplied fluid pressure to further actuate piston 200 such that a greater torque is applied to lead screw 1204.

Once this has occurred, fluid pressure vise actuator 1000 that is fully actuated in the direction configured to open vise 1202 is secured to vise 1202 and lead screw 1204 is disposed in socket 308 of gear 300. By doing so, rotation of socket 308 may rotate lead screw 1204 disposed in socket 308. In some cases, the size of socket 308 may be adjusted to interlock with lead screw 1204 such that socket 308 can rotate lead screw 1204 during actuation. Thus, by calibrating fluid pressure vise actuator 1000 and vise 1202 before operation of vises 1202, fluid pressure vise actuator 1000 is enabled to provide a consistent opening and closing of vise 1202 during operation and a consistent clamping force can be applied to the workpiece. By calibrating fluid pressure vise actuator 1000 a single time before securing to vise 1202, fluid pressure vise actuator 1000 is capable of automating the vise operating aspect of a manufacturing process in manufacturing an unlimited number of a particular part. Additionally, fluid pressure vise actuator 1000 is temporarily fixed to vise 1202 by a magnetic force between magnets 936, 938 and a portion of vise 1202. The magnetic force provided by the magnets is sufficient to prevent fluid pressure vise actuator 1000 from detaching from vise 1202 during operation of the vise. Fixation mechanisms such as, but not limited to, adhesives, mechanical clamps, screws, bolts, and velcro may also be used to fix fluid pressure vise actuator 1000 to vise 1202 and variety of vise fixtures without departing from the spirit or scope of the techniques described herein. Clamping blocks 928, 930 can also be adjusted to conform to vise 1202. For example, this may be achieved by loosening fixation mechanism 932, 934 and adjusting clamping blocks 928, 930 along groove 926 of housing 400. Once clamping blocks 928, 930 have been adjusted to conform to the geometry of vise 1202, fixation mechanism 932, 934 may be tightened. Notably, clamping blocks 928, 930 may prevent pressure vise actuator 1000 from rotating during operation of vise 1202. For instance, chamfered corners of clamping blocks 928, 930 are utilized to hold, grasp, and/or fix to a lower platform of vise 1202. This is necessary because a torque is applied to fluid pressure vise actuator 1000 due to the applied torque on lead screw 1204 of the vise 1202 during operation. It is to be appreciated that the clamping blocks 928, 930 may be adjusted to secure fluid pressure vise actuator 1000 to vise 1202 and a variety of vise fixtures in a variety of ways without departing from the spirit or scope of the techniques described herein.

CONCLUSION

Although the implementations of a fluid pressure vise actuator have been described in language specific to structural features and/or methods, it is to be understood that the appended claims are not necessarily limited to the specific features or methods described. Rather, the specific features and methods are disclosed as example implementations a fluid pressure vise actuator, and other equivalent features and methods are intended to be within the scope of the appended claims. Further, various different examples are described and it is to be appreciated that each described example can be implemented independently or in connection with one or more other described examples.

What is claimed is:

1. A vise operation system comprising:

a housing having a housing first end, a housing second end, and an inner bore extending between the housing first end and the housing second end;

at least one clamping block of the housing, wherein the at least one clamping block is configured to secure the housing on a vise;

a piston having a piston first end and a piston second end, the piston at least partially disposed in the inner bore of the housing;

a piston guide disposed in the inner bore of the housing, the piston guide having a channel, wherein a portion of the piston is disposed in the channel;

a gear at least partially disposed in the inner bore of the housing, wherein a first portion of the gear is adjacent to the piston; and a first port and a second port of the housing, the first port configured to supply pressurized fluid against the piston first end to actuate the piston through the channel in a first direction away from the housing first end and toward the housing second end effective to rotate the gear in a first rotational direction, and the second port configured to supply the pressurized fluid against the piston second end to actuate the piston through the channel in a second direction away from the housing second end and toward the housing first end effective to rotate the gear in a second rotational direction.

2. A system as described in claim 1, wherein an orientation of the at least one clamping block is adjustable to secure the housing on another vise.

3. A system as described in claim 1, further comprising at least one magnet of the housing, wherein the at least one magnet is configured to fix the housing to the vise by a magnetic force between the at least one magnet and a portion of the vise.

4. A system as described in claim 1, further comprising at least one pneumatic fitting configured to connect an airline to the first port wherein an end of the airline is disposed over a first end of the at least one pneumatic fitting and wherein a second end of the at least one pneumatic fitting is disposed in the first port.

5. A system as described in claim 4, wherein the at least one pneumatic fitting is configured to transfer the pressurized fluid from the airline into the first port.

6. A system as described in claim 1, further comprising an inner bore cover having an aperture, wherein a second portion of the gear is disposed in the aperture and wherein the inner bore cover is configured to attach to a face of the housing.

7. A system as described in claim 1, wherein the first port forms a stadium cylinder and wherein a portion of the piston first end is adjacent to a surface of the first port.

8. A system as described in claim 1, further comprising at least one piston sleeve disposed in the first port of the housing wherein the at least one piston sleeve is disposed over a portion of the piston first end.

9. A system as described in claim 1, further comprising an endcap fixed to the housing first end that is configured to seal the first port, wherein the supply of the pressurized fluid in the first port increases a magnitude of a force applied to the piston first end.

10. A system as described in claim 9, further comprising at least one damper disposed in the endcap.

11. A system as described in claim 9, wherein the endcap includes a pneumatic channel configured to connect a pathway between at least another pneumatic channel included in the housing and the first port, wherein the connected pathway is configured to transfer the pressurized fluid.

12. A vise operation system comprising:

a housing having a housing first end, a housing second end, and an inner bore extending between the housing first end and the housing second end;

a piston having a piston first end and a piston second end, the piston at least partially disposed in the inner bore of the housing;

a piston guide disposed in the inner bore of the housing, the piston guide having a channel, wherein a portion of the piston is disposed in the channel;

a gear at least partially disposed in the inner bore of the housing, wherein the gear has a socket that is configured to interface with a rotation mechanism of a vise to operate the vise and a first portion of the gear is adjacent to the piston; and a first port and a second port of the housing, the first port configured to supply pressurized fluid against the piston first end to actuate the piston through the channel in a first direction away from the housing first end and toward the housing second end effective to rotate the gear in a first rotational direction, and the second port configured to supply the pressurized fluid against the piston second end to actuate the piston through the channel in a second direction away from the housing second end and toward the housing first end effective to rotate the gear in a second rotational direction.

13. A system as described in claim 12, further comprising at least one pneumatic fitting configured to connect an airline to the first port, wherein an end of the airline is disposed over a first end of the at least one pneumatic fitting and wherein a second end of the at least one pneumatic fitting is disposed in the first port.

14. A system as described in claim 12, wherein a geometry of the socket is adjustable to interface with a rotational mechanism of another vise.

15. A system as described in claim 12, further comprising an adaptor having an adaptor first end and an adaptor second end, the adaptor first end is configured to interface with a geometry of the socket and the adaptor second end is configured to interface with a rotational mechanism of an additional vise.

16. A vise operation system comprising:

a housing having a housing first end, a housing second end, and an inner bore extending between the housing first end and the housing second end;

a piston having a piston first end and a piston second end, the piston at least partially disposed in the inner bore of the housing;

a piston guide disposed in the inner bore of the housing, the piston guide having a channel, wherein a portion of the piston is disposed in the channel;

a gear at least partially disposed in the inner bore of the housing, wherein a first portion of the gear is adjacent to the piston;

at least one sensor configured to detect a presence of a magnetic field; and a first port and a second port of the housing, the first port configured to supply pressurized fluid against the piston first end to actuate the piston through the channel in a first direction away from the housing first end and toward the housing second end effective to rotate the gear in a first rotational direction, and the second port configured to supply the pressurized fluid against the piston second end to actuate the piston through the channel in a second direction away from the housing second end and toward the housing first end effective to rotate the gear in a second rotational direction.

17. A system as described in claim 16, further comprising at least one pneumatic fitting configured to connect an airline to the first port, wherein an end of the airline is disposed over a first end of the at least one pneumatic fitting and wherein a second end of the at least one pneumatic fitting is disposed in the first port.

18. A system as described in claim 16, further comprising an inner bore cover having an aperture, wherein a second portion of the gear is disposed in the aperture and wherein the inner bore cover is configured to attach to a face of the housing.

19. A system as described in claim 16, wherein an actuation of the piston in the first direction causes the at least one sensor to detect the presence of the magnetic field and generate an output of a first electrical signal.

20. A system as described in claim 19, wherein an actuation of the piston in the second direction causes the at least one sensor to detect an absence of the magnetic field and causes at least one other sensor to detect the presence of the magnetic field and generate an output of a second electrical signal.

* * * * *